US009657561B1

(12) United States Patent
Bargach et al.

(10) Patent No.: US 9,657,561 B1
(45) Date of Patent: May 23, 2017

(54) DOWNHOLE POWER CONVERSION AND MANAGEMENT USING A DYNAMICALLY VARIABLE DISPLACEMENT PUMP

(71) Applicant: ISODRILL, INC., Bellville, TX (US)

(72) Inventors: Saad Bargach, Bellville, TX (US); Stephen D. Bonner, Sugar Land, TX (US); Raymond V. Nold, III, Beasley, TX (US); James P. Massey, Breckenridge, CO (US); Jon A. Brunetti, Katy, TX (US)

(73) Assignee: ISODRILL, INC., Bellville, TX (US)

( * ) Notice: Subject to any disclaimer, the term of this patent is extended or adjusted under 35 U.S.C. 154(b) by 0 days.

(21) Appl. No.: 14/989,682

(22) Filed: Jan. 6, 2016

(51) Int. Cl.
*E21B 44/00* (2006.01)
*E21B 4/02* (2006.01)
*E21B 7/06* (2006.01)

(52) U.S. Cl.
CPC ..... *E21B 44/005* (2013.01); *E21B 4/02* (2013.01); *E21B 7/068* (2013.01)

(58) Field of Classification Search
CPC ..... E21B 4/02; E21B 7/068; E21B 44/005
USPC ..... 175/26
See application file for complete search history.

(56) References Cited

U.S. PATENT DOCUMENTS 3,575,534 A 4/1971 Leduc
3,743,034 A 7/1973 Bradley
3,841,420 A 10/1974 Russell
3,945,443 A 3/1976 Barnes
3,985,472 A 10/1976 Virtue et al.
4,013,134 A 3/1977 Richmond et al.
4,042,046 A 8/1977 Capoccia
4,143,996 A * 3/1979 Sullivan ..... F04B 9/02 417/15
4,149,830 A 4/1979 Woodruff
4,158,529 A 6/1979 Nonnemacher et al.
4,340,337 A 7/1982 Bristow et al.
4,347,044 A 8/1982 Ahlen et al.
4,359,130 A 11/1982 Kirkham
4,382,485 A 5/1983 Kirkham
4,383,412 A 5/1983 Presley
4,412,789 A 11/1983 Ohe et al.
(Continued)

OTHER PUBLICATIONS

Schlumberger; MDT Modular Formation Dynamics Tester, from www.connect.slb.com, Copyright Jun. 2002.

*Primary Examiner* — Taras P Bemko
(74) *Attorney, Agent, or Firm* — Morgan, Lewis & Bockius LLP

(57) ABSTRACT

A dynamically controllable variable displacement axial piston pump is described. In an embodiment, the pump comprises a rotating cylinder with hydraulic pistons that contact the face of a swash plate. The angle of the swash plate can be controlled to thereby control the movement of the pistons, the displacement of the pump, and the power generated by the pump. The dynamically controllable variable displacement axial piston pump may be used in combination with a rotary steerable apparatus, including such an apparatus as described herein that uses hydraulic pistons to actuate the deflection of the bit, or in combination with other downhole tools and devices. When used down hole in a drill string with a drilling mud powered turbine, the dynamically controllable variable displacement pump limits and regulates the power provided to the tool over a wide range of drilling mud weights and flow rates.

26 Claims, 25 Drawing Sheets

(56) References Cited

U.S. PATENT DOCUMENTS 4,445,818 A 5/1984 Ohsaki et al.
4,498,846 A 2/1985 Gassman
4,526,241 A 7/1985 Anders
4,538,966 A 9/1985 Nikaido
4,599,050 A 7/1986 Ishizaki et al.
4,648,803 A 3/1987 Stephenson et al.
4,711,616 A 12/1987 Tsukahara et al.
4,750,866 A 6/1988 Entwistle
4,899,835 A 2/1990 Cherrington et al.
4,974,688 A 12/1990 Helton
RE33,751 E 11/1991 Geczy et al.
5,113,953 A 5/1992 Noble et al.
5,778,992 A 7/1998 Fuller
6,029,445 A 2/2000 Lech
6,092,610 A 7/2000 Kosmala et al.
6,109,372 A 8/2000 Dorel et al.
6,158,529 A 12/2000 Dorel
6,213,205 B1 4/2001 Surjaatmadja
6,439,321 B1 8/2002 Gillis et al.
6,601,658 B1 8/2003 Downton
6,742,604 B2 6/2004 Brazil et al.
6,840,336 B2 1/2005 Schaaf et al.
6,843,332 B2 1/2005 Eppink et al.
7,136,795 B2 11/2006 Downton
7,168,507 B2 1/2007 Downton
7,188,685 B2 3/2007 Downton et al.
7,195,083 B2 3/2007 Eppink et al.
7,506,696 B2 3/2009 Weston et al.
7,510,027 B2 3/2009 Weston et al.
7,669,669 B2 3/2010 Downton et al.
7,717,194 B2 5/2010 Weston et al.
7,823,661 B2 11/2010 Mintchev et al.
7,841,406 B2 11/2010 Zazovsky et al.
7,860,696 B2 12/2010 Chen
7,878,267 B2 2/2011 Southard
7,909,117 B2 3/2011 Van Steenwyk et al.
7,934,547 B2 5/2011 Milkovisch et al.
7,975,778 B2 7/2011 Weston et al.
7,984,769 B2 7/2011 Haughom et al.
8,118,112 B2 2/2012 Juvonen
8,141,657 B2 3/2012 Hutton
8,157,024 B2 4/2012 De Paula et al.
8,235,145 B2 8/2012 Haugvaldstad et al.
8,235,146 B2 8/2012 Haugvaldstad et al.
8,464,811 B2 6/2013 Shepherd
8,474,552 B2 7/2013 De Paula et al.
8,505,289 B2 8/2013 Harsia
8,528,219 B2 9/2013 Barnes
8,579,044 B2 11/2013 Allen et al.
8,590,636 B2 11/2013 Menger
8,668,465 B2 3/2014 Wadsley et al.
8,726,650 B2 5/2014 Kotsonis et al.
8,763,725 B2 7/2014 Downton
8,800,687 B2 8/2014 Shepherd
8,801,407 B2 8/2014 Simpson
8,887,834 B2 11/2014 Millet
8,905,130 B2 12/2014 Landsiedel
8,905,732 B2 12/2014 Kuttler et al.
8,925,636 B2 1/2015 Cumming et al.
8,960,329 B2 2/2015 Downton
8,967,296 B2 3/2015 Downton
8,985,218 B2 3/2015 Bedouet et al.
9,016,401 B2 4/2015 Savage et al.
9,057,223 B2 6/2015 Perrin et al.
9,091,122 B2 7/2015 Millet
9,109,402 B1 8/2015 Lasater et al.
9,169,620 B2 10/2015 Gabibulayev
9,187,956 B2 11/2015 Hutton et al.
9,206,647 B2 12/2015 Prill et al.
9,217,422 B2 12/2015 Davis
9,238,961 B2 1/2016 Bedouet
2002/0007969 A1* 1/2002 Head ..... E21B 7/067 175/61
2003/0094310 A1 5/2003 Eppink et al.
2003/0121702 A1 7/2003 Downton et al.
2003/0127252 A1 7/2003 Downton et al.
2004/0057336 A1 3/2004 Smith
2005/0008498 A1 1/2005 Zumbusch
2005/0029484 A1 2/2005 Belser
2005/0098350 A1 5/2005 Eppink et al.
2006/0006000 A1 1/2006 Weston et al.
2006/0168955 A1 8/2006 Longfield et al.
2006/0260805 A1 11/2006 Longfield
2007/0187147 A1 8/2007 Weston et al.
2007/0251726 A1 11/2007 Menger
2007/0289319 A1 12/2007 Kim et al.
2008/0083567 A1 4/2008 Downton et al.
2008/0107545 A1 5/2008 Hoji
2008/0156487 A1 7/2008 Zazovsky et al.
2008/0247882 A1 10/2008 Earhart et al.
2009/0032302 A1 2/2009 Downton et al.
2009/0044951 A1 2/2009 Milkovisch et al.
2009/0090525 A1 4/2009 Juvonen
2009/0166089 A1 7/2009 Millet
2009/0178851 A1 7/2009 Weston et al.
2009/0188717 A1 7/2009 Haughom et al.
2009/0314546 A1 12/2009 Mintchev et al.
2010/0006341 A1 1/2010 Downton
2010/0025116 A1 2/2010 Hutton
2010/0032212 A1 2/2010 Van Steenwyk et al.
2010/0065333 A1 3/2010 Kiyosawa
2010/0139980 A1 6/2010 Neves et al.
2010/0218994 A1 9/2010 Weston et al.
2010/0293938 A1 11/2010 Doberschuetz
2010/0322791 A1 12/2010 Wadsley et al.
2011/0020159 A1 1/2011 Kuttler et al.
2011/0036631 A1 2/2011 Prill et al.
2011/0098929 A1 4/2011 Tabanou et al.
2011/0100716 A1* 5/2011 Shepherd ..... A61F 13/15747 175/73
2011/0139508 A1 6/2011 Haugvaldstad et al.
2011/0164999 A1 7/2011 Meek
2011/0185717 A1 8/2011 Kotsonis
2013/0129460 A1 5/2013 Gabibulayev
2014/0110178 A1 4/2014 Savage et al.
2015/0050165 A1* 2/2015 Zavadinka ..... F04B 1/324 417/270
2015/0211396 A1* 7/2015 Tsuji ..... F04B 1/22 92/153

* cited by examiner

DOWNHOLE POWER CONVERSION AND MANAGEMENT USING A DYNAMICALLY VARIABLE DISPLACEMENT PUMP

TECHNICAL FIELD

The apparatus and methods disclosed in this invention relate to the drilling of wells and the precision navigation and placement of well bore trajectories, including wells for the production of hydrocarbon crude oil or natural gas. More specifically, the apparatus and methods disclosed in this invention relate to a rotary drilling bottom hole assembly that is steerable and a positive displacement power section, which may be used independently or in combination with each other.

BACKGROUND

Rotary steerable drilling systems have long been used in directional drilling for hydrocarbons. In general, such systems have used either "push-the-bit" or "point-the-bit" technology. The former type of system continuously decenters the bit in a given direction, while the latter changes the direction of the bit relative to the rest of the tool. Both types of existing rotary steerable systems offer significant advantages, although both also suffer from certain drawbacks, as discussed in further detail below.

One early disclosure for a rotary steerable drilling apparatus and method dates back at least as far as 1973 and is described by Bradley in U.S. Pat. No. 3,743,034 (hereinafter "Bradley"). This disclosure covers a range of topics such as using a mud driven downhole turbine or an electric motor to drive a positive displacement hydraulic pump, the use of a universal joint to connect two shafts which can be arbitrarily and continuously articulated relative to each other, and using hydraulic pistons as actuators to continuously maintain a desired direction of offset that is constant with respect to a terrestrial datum as the tool is rotating. Since Bradley precedes the commercial application of microprocessors in down hole tools, it relies on a high speed telemetry link to the surface using wired drill pipe in which segments of insulated electrical conductor are built into each joint of drill pipe (as described by Fontenot in 1970 in U.S. Pat. No. 3,518,699) to carry electrical signals through the drill pipe to the surface in order to control the steering of the tool. Bradley disclosed controlling the angle of deflection of the bias unit by regulating the length of time of opening and closing the piston control valves, the same valves that also control the direction of drilling in this configuration, to allow greater or lesser amounts of fluid to enter or leave the pistons thereby changing the amplitude of the reciprocating motion of the pistons.

Some earlier designs of rotary steerable tools use the drilling mud and the pressure drop across the bit to actuate the bias unit mechanism, regardless of whether it is using the point the bit technique, push the bit technique, or a combination of the two. Other earlier tool designs may use a mud turbine driving an electrical alternator to generate the electric power to displace the bit and maintain angular displacement.

The rotary steerable apparatus that is the subject of this disclosure solves a number of operational limitations associated with existing rotary steerable systems. Initially, it is important to note that this disclosure encompasses two distinct inventions, both of which are described in more detail below—a dynamically variable displacement axial piston pump and a hinge joint that limits the articulation of the bit to a single degree of freedom (instead of a universal joint with 2 or more degrees of freedom), providing spatially phased coherent symmetrical bidirectional deflection of the drill bit. Both inventions may be used together but either may also be used independently of the other. The term "spatial phasing" refers to the dynamic timing of an event or action related to the articulation of the bit, as the tool is rotating, with respect to a fixed terrestrial datum such as gravity or the earth's magnetic field. The spatial phase is expressed in terms of the instantaneous rotational orientation (a tool face) of a reference mark on the tool with respect to gravity (gravity tool face) or the earth's magnetic field (magnetic tool face).

Firstly, with respect to the advantages of the dynamically variable displacement axial piston pump, using a fixed positive displacement pump down hole to generate hydraulic power works only over a very narrow range of mud flow rates. If the turbine is generating enough power at the low end of the flow range, then it will be potentially generating too much power at the upper end of the flow range unless the allowable flow range is extremely narrow, thereby restricting the ability of the tool pusher to optimize the drilling parameters for efficiency and safety without damaging the tool. The novel use of a dynamically variable displacement axial piston pump disclosed herein solves this problem by dynamically reducing the displacement of the pump per revolution to maintain a constant power output as the mud flow increases, and dynamically increasing its displacement per revolution as the mud flow decreases. Secondly, the amplitude of the bit deflections, whether static or oscillatory, can be controlled by further adjusting the displacement per revolution of the dynamically variable displacement pump, allowing for control of the amplitude of the bit articulation independent from the control of the direction of drilling as the tool is rotating, whether the objective is to maintain a constant bit offset angle independent of rotation or if the bit is reciprocating at the same frequency as the rotation of the drill collar.

As used herein, the term "dynamically variable displacement axial piston pump" refers to a hydraulic pump with a rotating cylinder, driven by a drive shaft, that can be configured with two or more pistons, symmetrically arranged in the cylinder, that reciprocate in a direction that is parallel to the axis of rotation of the cylindrical piston block. The structure of this pump is described in further detail in the following sections of this disclosure. One end of each piston may end with a "slipper cup" that contacts and slides on the face of a swash plate. The swash plate is not connected to the drive shaft. Instead, the swash plate is mounted on a separate axle, the centerline of which is orthogonal to but intersects the center line of the driveshaft. When the face of the swash plate is perpendicular to the axis of the drive shaft, this is referred to as a swash plate angle of "zero degrees." In this swash plate position, as the cylinder block rotates, the pistons do not reciprocate and the displacement of the pump is zero. As the tilt angle of the swash plate is increased to some angle θ, the pistons begin to reciprocate, increasing the displacement of the pump according to the equation $Q=Q_O*\sin(\theta)$, where $Q_O=[Q_{MAX}/\sin(\theta_{MAX})]$, where $Q_{MAX}$ is the maximum practical displacement of the pump per revolution of the drive shaft at the maximum practical swash plate angle $\theta_{MAX}$. The other end of the pistons are connected to the hydraulic fluid ports "A" and "B" of the pump. Depending on whether the swash plate angle is positive or negative, "A" will be the outlet and "B" the inlet, or "A" will be the inlet and "B" will the outlet, respectively. The swash plate angle can be controlled by an electrical actuator or a hydraulic actuator through a linkage that is connected to the swash plate. The position of the swash plate can be measured by an LVDT ("linear variable differential transformer") or a simple potentiometer. In a preferred embodiment, the swash plate angle is dynamically controlled by a steering control module.

Thirdly, the use of a dynamically variable displacement axial piston pump allows for instantaneous and continuously variable control of the dog leg severity of the well bore in the curved sections without having to bypass excess high pressure fluid back to tank. For tools that use the drilling mud and the pressure drop across the bit to actuate the steering control surfaces, the actuation is typically all or none. In those cases, it is not possible to partially actuate the bit deflection. By allowing for the partial actuation of bit deflection, a finer granularity of steering adjustment can be achieved and maintained while drilling.

The second invention disclosed herein relates to a hinge joint that limits the articulation of the drill bit with respect to the tool to a single degree of freedom. As will be explained in the discussion that follows, limiting the articulation of the bit to a single degree of freedom relative to a fixed point on the tool and using the method of coherent symmetrical bidirectional deflections spatially phased relative to a fixed terrestrial datum, to control the direction of drilling, allows the use of a single axis hinge instead of a two-degree of freedom universal joint to attach the bit to the bottom of the rotary steerable drilling tool. The novel method that is required to steer the well and fully benefit from the simplified mechanics of the novel rotary steerable drilling tool is referred to as "spatially phased coherent symmetrical bidirectional deflection" of the bit. This will be explained in more detail later in this disclosure. The hinge limits the motion of the bit to a single degree of freedom. However, two degrees of freedom are required in order to steer a well towards an intended target. In the invention of this disclosure, the second degree of freedom is provided by the rotation of the rotary steerable drilling tool while drilling ahead.

A BHA or "bottom hole assembly" describes the lower or bottom section of the drill string that terminates with the bit and extends up-hole to the point just below the lower end of drill pipe. In addition to the bit, the BHA can be comprised of any number of drill collars for added weight or special purpose collars that may or may not be included such as, but not limited to: stabilizers, under-reamers, positive displacement mud motors, bent subs, instrumented drill collars for the measurement of various formation and environmental parameters (for the determination, versus depth and time, of the mixture and volume of fluids in the formation or formation lithology or formation and borehole mechanical properties or borehole inclination and azimuth), or rotary steerable tools, such as the subject of this disclosure. The components that are part of a given BHA are selected to optimize drilling efficiency and well bore placement and geometry.

The timing or spatial phasing of the bit deflections is controlled so that, to an observer that is stationary with respect to the earth, the bit is reciprocatingly deflected in the same direction for every 180° of BHA rotation. Conversely, to an observer that rotates with the tool, i.e., is stationary with respect to the tool, for each 360-degree rotation of the tool, they will see a positive bit deflection towards a fixed reference mark (a "scribe line") followed by a negative bit deflection away from the scribe line reference mark, the two deflection events separated by 180° of tool rotation.

Other benefits of using a single degree of freedom of articulation relative to a fixed point on the collar will be explained further in the disclosure that follows. Although it is not a preferred embodiment of the invention, it should be understood that a hydraulic dynamically variable displacement pump could also be used to control downhole tools other than the rotary steerable tool described above, including but not limited to a more conventional system with multiple actuators and a pivot with multiple degrees of freedom of articulation to continuously maintain an angle of articulation of the bit in a particular direction that is fixed with respect to the earth or to control the counter rotation speed of a geostationary assembly to maintain a fixed orientation of the geostationary assembly with respect to the earth as the tool rotates.

SUMMARY

An objective of one aspect of the present invention is to provide a novel dynamically controlled rotary steerable drilling tool, threadably connected to a rotary drive component such as the output shaft of a mud motor or a rotary drill string that is driven by a rotary table or top drive of a drilling rig, that enables the directional drilling of selected well bore sections, whether curved or straight, by precision steering of the well bore towards a subsurface target. The rotary steerable drilling tool will be able to drill out of the casing shoe, drill the curve and the drain hole to target depth and target "reach" with the specified inclination and azimuth, in a single bit run, minimizing the rig time to complete the well.

One problem that this aspect of the present invention seeks to address is to minimize the mechanical complexity of a dynamically controlled rotary steerable drilling tool. In a preferred embodiment, this is accomplished by using the simplest articulating attachment of the bit assembly to the lower end of the rotary steerable drill collar, namely a simple hinge. The bit assembly includes the bit attached to the bottom end of an articulating bit shaft. Attaching the upper end of the bit shaft to the drill collar by means of a simple hinge joint limits the articulation of the bit assembly to a single degree of freedom with respect to a reference coordinate system attached to and rotating with the rotary steerable drill collar (the "tool coordinate system"). During active steering operations, the long axis of the bit assembly is reciprocatingly, bidirectionally, and symmetrically deflected at the same frequency as the rotation of the rotary steerable drill collar by means of a single bidirectional actuator that rotates with the rotary steerable drill collar. Further mechanical simplification may be derived from the computational implementation of an optional 9-axis virtual-geostationary navigational platform comprised of sensors that are packaged in a physical chamber that is fixed to and rotates with the rotary steerable drill collar, thereby eliminating any geostationary and/or near-geostationary mechanical assembly or apparatus that counter rotates relative to the rotary steerable drill collar but is otherwise a part of the rotary steerable BHA. Eliminating the need for a geostationary and/or near geostationary mechanical assembly eliminates the ancillary need for rotating electrical connections (e.g., slip rings), pressure seals, and bearings.

One difference between the above-described embodiment of the rotary steerable drilling tool apparatus disclosed herein and other rotary steerable drilling tools is that a bidirectionally reciprocating bit shaft is mechanically connected to the bottom of the rotary steerable drill collar by means of a single axis hinge that transmits torque and weight from the rotary steerable drill collar to the bit shaft and bit.

This design contrasts with the more complex attachment and actuation mechanics that are required to support two or more degrees of freedom of articulation for tools that continuously point-the-bit in a given direction with respect to a terrestrial datum as the rotary steerable tool rotates, for example, splined ball joints, CV joints, or universal joints with multiple independent actuators. For push-the-bit tools that continuously decenter the bit in a given direction, multiple actuators and/or control surfaces are required, and the ability to maintain the de-centered bit location while drilling may be constrained by the number and placement of the configured actuators.

The method of steering a well in a particular direction with respect to gravity or magnetic north is accomplished by controlling the spatial phasing of said coherent symmetrical reciprocating deflections of said bit shaft with respect to either gravity tool face (GTF) or magnetic tool face (MTF), as the tool rotates. (An instantaneous GTF of zero degrees corresponds to the point when a reference mark on the tool, known as a "scribe line," is oriented towards the top of the bore hole. An instantaneous GTF of 180° corresponds to the point when the scribe line is oriented towards the bottom of the bore hole. Similarly for MTF, an instantaneous MTF of zero degrees corresponds to the point when the scribe line is oriented towards magnetic north; and an instantaneous MTF of 180° corresponds to the point when the scribe line is oriented towards magnetic south. In the case of a perfectly vertical bore hole, the value of GTF is indeterminate. And similarly for MTF, in the case where the bore hole azimuth is due north or south and the inclination of the bore hole is equal to the local dip of the earth's magnetic field, then the value of MTF is indeterminate.) This enables the bit to preferentially remove formation on a particular side of the bore hole ("the frontside") while removing less formation on the opposite side of the bore hole ("the backside") in order to change the direction of the well bore towards a target inclination and/or azimuth for the purpose of drilling a curved and/or straight well bore progressively towards an intended geometrical or geological target or for the active drilling of vertical wellbores. This method allows for a borehole diameter that is slightly enlarged from zero to about 5 percent of the nominal bit diameter in the curved sections, thereby reducing the frictional forces and mechanical stress concentrations on the BHA and other tubulars as they slide or rotate through the dog leg, resulting in less drag on the drill string and hence more weight and torque on the bit while in the curve and below the curve. The slight enlargement of the borehole during steering operations while drilling a curved section is a direct result of the steering motion of the bit while the tool is rotating. This will be explained in detail in the discussion of FIGS. 7C and 7D, below. The deflection of the bit during steering operations increases the effective cutting diameter of the bit by a few percent in the preferential direction of steering. At the same time that additional material is being preferentially removed from the "front side" of the hole in the direction in which the tool is being steered, less material is being removed from the "back side" of the hole, resulting in a curved well bore trajectory with a slightly enlarged borehole diameter. Another advantage of the novel method disclosed herein is that during steering operations, while in the curve, additional mechanical cutting power is being added to the bit as it drills ahead. This is due to the additional motion imparted to the bit as a result of steering operations. The other methods that maintain a constant decentered or angled orientation of the drill bit as the tool rotates do not add any additional cutting power to the bit. In practical terms, the additional mechanical cutting power provided to the bit 12 results in faster drilling in the curve and higher overall drilling efficiency.

Using the method of spatially phased coherent symmetrical reciprocating motions of the bit for directional drilling is in direct contrast with traditional point-the-bit systems that continuously maintain a given offset angle of the bit axis of rotation with respect to the axis of BHA rotation and a fixed terrestrial datum that is independent of the rotation of the rotary steerable drilling tool as the collar is rotating during steering operations, requiring mechanical articulation and actuation with two or more degrees of freedom. Additionally, using spatially phased coherent bidirectional symmetrical reciprocating deflections of the bit is in direct contrast with traditional push-the-bit systems that continuously maintain a constant parallel lateral offset of the bit axis of rotation with respect to the axis of BHA rotation and a fixed terrestrial datum that is independent of the rotation of the rotary steerable drilling tool as the collar is rotating during steering operations, requiring mechanical actuation with two or more degrees of freedom to continuously generate sideways decentering forces in a given direction.

Some embodiments of the invention use a drilling mud powered dynamically variable displacement axial piston pump that regulates the variable and/or fluctuating input power available from a drilling mud driven turbine and also regulates the output flow rate of pressurized hydraulic fluid to the load in response to the power demands of the bias unit actuators to instantaneously and continuously control the deflection force and deflection amplitude of the coherent symmetrical bidirectional reciprocations of the bit shaft and drill bit. The term "bias unit" describes that section of the rotary steerable tool that "biases" or steers the tool in a given direction. The bias unit is comprised of the bit, actuation and control means for decentering or articulating the bit, a collar, optionally one or more centralizers, and a source of power. The output of the pump drives a single bidirectional hydraulic piston with a force axis that is oriented orthogonally to both the axis of the hinge and the axis of rotation of the BHA, that actuates said spatially phased coherent symmetrical reciprocations of the bit shaft and bit for the purposes of steering the well bore in said selected direction. During active steering operations, the dynamically variable displacement axial piston pump enables the continuously variable control of the amplitude of said coherent symmetrical reciprocating deflections of said bit assembly in order to control the dog leg severity (rate of curvature) of said change of direction of the wellbore and to dynamically control the lateral steering forces applied to the bit responsive to the mechanical properties of the formation, the cutting dynamics and health of the bit, the detected incipience of stick-slip rotation and/or to allow stick-slip rotation up to some preset limit.

In an embodiment of the tool, the amplitude and spatial phasing of said coherent bit reciprocations are controlled by an on-board down-hole tool microcontroller and/or microprocessor assembly. This assembly may have varying configurations which can include a microcontroller and/or microprocessor, memory, nonvolatile memory, input/output channels, various navigational sensors, and/or programming stored to memory that the assembly executes when in operation. The down-hole tool microcontroller and/or microprocessor assembly generates the steering control signals in response to either surface generated commands or autonomous algorithmic commands derived from acquired down hole navigational parameters, or a combination thereof. Thus the rotary steerable drilling tool of this invention is dynamically adjustable while the tool is located down-hole and during drilling for controllably changing the inclination and azimuth of the well bore trajectory as desired. The spatial phasing of said coherent reciprocations is independently controlled, separate from the amplitude of the reciprocations, while rotating to progressively drill the well in a given direction. Conversely, the amplitude of said reciprocations can be dynamically adjusted independently from the spatial phasing of said reciprocations, to continuously and progressively increase or decrease the rate of curvature of the well bore to achieve the intended well bore trajectory and to optimize well bore quality and smoothness. In an embodiment of the present invention, during steering operations, the duty cycle of each of the individual valves that operate the hydraulic actuator is 50%, i.e., the on time of each valve is approximately equal to the off time. In addition, the valves are out of phase with respect to each other. As one valve is ON, the other valve is OFF. As one valve is transitioning from OFF to ON, the other valve is transitioning from ON to OFF. As the tool rotates, the timing of the valve control signals with respect to GTF or MTF controls the spatial direction in which the tool is drilling but not the amplitude of the bit articulations. Instead, controlling the swash plate angle of the dynamically variable displacement axial piston pump controls the amplitude of the bit articulations. This method of independently controlling the amplitude of the articulations separately from the timing of the articulations of the bit as the tool is rotating results in a smooth and repeatable resultant bit motion, regardless of the amplitude of the articulations. This method is to be contrasted with the method disclosed by Bradley which will result in blocky and sudden bit movements as the tool attempts to maintain a constant offset angle of the bit in a constant direction relative to the axis of rotation of the tool. Bradley discloses varying the duty cycle of the individual valves that operate each of the hydraulic actuators to control the amplitude of the bit articulations simultaneous with controlling the timing of each valve turning on and off to control the direction in which the tool is drilling.

Rotary steerable drilling tools can rely on accelerometers, magnetometers, and gyroscopes to provide navigational information for the steering of subterranean wells for the production of oil and gas or the injection of water and/or steam. These navigational sensors can be packaged into a secondary assembly within the rotary steerable drilling tool that counter rotates with respect to the drill collar so that the sensors maintain a stationary relationship with respect to the earth, often referred to as a "geostationary platform." However, the concept of a counter rotating geostationary platform brings with it ancillary mechanical complexity in terms of seals, bearings, and slip rings, as well as a means of controlling and maintaining the counter rotation with variable BHA rotation rates and the significant mechanical inertia of the geostationary platform. Bradley U.S. Pat. No. 3,743,034 suggests the use of an "inertial reference" mounted directly to a chamber in the rotating drill collar—in this case, "a reference such as the center of a gimbled (sic) gyroscopic platform," packaged into the articulating section of the tool located below the universal joint connection—to determine in which direction the bit is pointing. An "inertial reference" is by definition a non-rotating or geostationary reference. Hence, by gimbal mounting the gyroscope in a rotating housing, the gyroscope is a defacto geostationary reference that maintains a constant orientation of the gyroscopic platform with respect to the earth by the angular momentum of the gyro.

In an embodiment of the present invention, accelerometers and magnetometers are packaged in and rotate with the tool comprising a "non-inertial rotating navigational platform." One benefit of relying on a rotating navigational platform instead of a geostationary inertial navigational platform is that the physical mounting alignment errors of the navigational sensors, specifically the accelerometers and magnetometers can be minimized or cancelled out to improve the accuracy of the measurements, with the result that the placement of the borehole will be as intended by the customer. There are at least two sources of mechanical misalignment errors when using accelerometers and magnetometers. The first is the misalignment of the device within its package, and the second is the misalignment of the mounting of the package to a PC board or a chassis in the tool. Mechanical misalignment errors affect the relative orthogonality of each of the sensors' axes of sensitivity. Accelerometers can be further affected by centripetal effects when not precisely mounted on the tool axis of rotation. For some dual axis micro-electrical-mechanical systems ("MEMS"), the relative orthogonality of the axes is determined by the lithographic process used to manufacture the device, resulting in near perfect orthogonality, virtually eliminating a source of error when compared with orthogonally mounted single axis devices. The errors caused by misalignment can be important either when actively steering a vertical well bore and the inclination (tilt) of the borehole is by definition very close to zero degrees or when the borehole inclination is close to horizontal. When actively drilling a vertical well, the inclination is typical specified to be within about 1 degree of vertical. For example, for a 10,000-foot target depth, the bottom of the vertical well bore section should not have drifted laterally by more than 175 feet in any direction relative to drilling rig on the surface or the subsea entry point on the sea bed. For transverse measurements of gravity and magnetic field made with a rotational navigational platform, the misalignment and electrical offset errors occur at DC while the measurements of interest have the same AC frequency as the rotation rate of the tool. Further, any gain or sensitivity differences between two orthogonal transverse channels caused by mounting misalignment can be easily dynamically corrected by normalizing the amplitude of the AC measurements of one channel relative to the other to improve the accuracy of the measurements. In addition, for the transverse magnetic field measurement, there will be a small correction needed to compensate for the AC electromagnetic skin effect that is proportional to the frequency of rotation. The phase correction could be as much as 15° and the amplitude correction could be as much as 2.6 dB. The effect is repeatable and can be empirically derived as a function of frequency and temperature. For the axial measurements of gravity and magnetic field made with a rotational navigational platform, the misalignment errors occur at a frequency equal to the rotation rate of the tool. The amplitude of the AC error signal will give a quantitative indication of the axial misalignment to allow a small correction factor to be applied to the DC component of the measurement. Proper low pass filtering of the AC error signals will remove the error. For the axial magnetic signal, no compensation for electromagnetic skin effect is needed since the axial component of magnetic field is at DC whether the collar is rotating or not. However, using a rotational navigational platform does not eliminate the need for DC offset and gain thermal characterization for the axial devices and gain thermal characterization for the transverse devices.

Assume for example in a vertical well being drilled with a geostationary navigational platform that the x, y, and z accelerometers are each misaligned by some small arbitrary angle in an arbitrary direction with respect to a Cartesian coordinate system fixed to the tool. Then when making a static survey, which can take several minutes to acquire, the misalignment of the accelerometers with respect to the axis of the tool will affect the accuracy of the survey and introduce a source of error into the well bore trajectory unless it is properly calibrated and accounted for. Consider that the accelerometers are typically mounted orthogonally to each other with respect to a Cartesian coordinate system that rotates with the tool, with the z-axis oriented so that it points down hole towards the bit along the axis of rotation of the BHA. Two other transverse axes are labeled "x" and "y" and form a right handed coordinate system with "z" so that $i_x$ cross $i_y$ equals $i_z$, where $i_x$, $i_y$, and $i_z$, are the unit vectors corresponding to their respective Cartesian axes attached to the tool. While rotating, the misalignment error behaves differently for the x & y transverse sensors than it does for the z axis sensors. For the transverse sensors, the primary sensitivity is orthogonal to the axis of rotation which yields an AC signal with a frequency equal to the frequency of rotation and an amplitude proportional to the value of the borehole tilt angle. Transverse misalignment error yields a small vector sensitivity in the z direction along the tool axis. Hence, the transverse sensor error response caused by the misalignment is independent of tool rotation, i.e., it is a DC offset. Using superposition, the total transverse sensor signal is the primary AC signal with a small DC offset superposed on it. For axial sensors, the converse is true, misalignment error yields a small vector sensitivity transverse to the tool axis. Using superposition, the total axial sensor signal is the primary DC signal that is proportional to the earth's gravity times the cosine of the tilt angle plus a small AC misalignment error signal superposed on it. However, the misalignment error of an axial sensor is simply cancelled by averaging the samples over an integral number of BHA rotations.

In the case of a vertical well bore such that the z-axis of the tool is precisely aligned with earth's gravity vector, i.e., when the tilt angle is zero degrees, the x and y transverse accelerometers will not have any AC component, only a small DC sensor offset. When the AC amplitude of the transverse accelerometers is zero, this confirms that the well bore is vertical. When the borehole starts to deviate away from the vertical direction, i.e., when the borehole starts to tilt, the AC amplitude of the x and y transverse accelerometers begins to increase, with the amplitude being proportional to amount of the tilt. The axially oriented z-axis accelerometer measures the cosine of the tilt angle times the earth's gravity and since the cosine of the tilt angle is rather insensitive to small changes in tilt angle when the axial accelerometer is aligned with the earth's gravity vector, it is not suitable for vertical drilling control. In practice, for the case where the tool axis of rotation is tilted at some angle relative to the earth's gravity vector, the transverse accelerometers can be used dynamically to quantify the borehole inclination up to about 75° of inclination angle by using the amplitude of the fundamental frequency of the AC signal of the transverse accelerometers. Above about 75°, the DC signal from the "z axis" accelerometer should be used for a dynamic measurement of borehole inclination.

When using accelerometers dynamically at the rotation rate of the BHA, Gaussian noise reduction techniques are used to lessen the effects of accelerations caused by random shocks and vibrations. For best results, the frequency response of the navigational accelerometers should be band limited by the physics of the device so that the device is inherently insensitive to high frequency shocks and vibrations which can be large, saturating the device outside the frequency band of interest, affecting the accuracy of the device in the band of interest. The "frequency band of interest" is typically understood to mean frequencies below about 2 or 3 times the maximum rotation rate of the BHA. Additionally, proper device selection will minimize vibration rectification effects, allowing for the full benefits of noise filtering to be realized for the robust computation of bore hole tilt inclination, bore hole tilt azimuth, and the instantaneous GTF and MTF of the tool.

An embodiment of the present invention relies on a fully autonomous virtual geostationary platform with autocorrecting and self-calibrating measurements to generate the signals and timing required to dynamically steer the rotary steerable drilling tool in a desired direction with respect to a terrestrial datum or target. Three orthogonal accelerometers, three orthogonal magnetometers, and three orthogonal rate gyroscopes are disposed in the tool to cover a wide range of drilling conditions, well bore tilt angles, and cases where the earth's magnetic field is either distorted by nearby well casings or if the well bore trajectory runs north-south or south-north and the well bore tilt inclination is within a few degrees of coinciding with the local dip angle of the earth's magnetic field. These 9 axes are dynamically combined over a wide range of BHA rotation rates from zero RPM up to several hundred RPM. The "geostationary" outputs of the rotating virtual geostationary platform are borehole tilt inclination and borehole tilt azimuth. The instantaneous or dynamic outputs are GTF, MTF, the local angle between GTF and MTF (Angle X), and the instantaneous rotation frequency. These 6 outputs are used to control the timing of the actuators that dynamically deflect the bit and cause the rotating tool to steer the well in a particular direction that is fixed with respect to the earth.

In an embodiment, the virtual geostationary platform can include a separate virtual geostationary platform microcontroller and/or microprocessor assembly ("VGPMA") or it may use the microcontroller and/or microcontroller assembly of another system, such as that of the rotary steerable assembly as described above. The VGPMA, if configured, may have varying configurations which can include a microcontroller and/or microprocessor, memory, nonvolatile memory, input/output channels, various sensors, and/or programming stored to memory that the assembly executes when in operation. Additionally, as discussed in the above paragraph, the virtual geostationary platform can be configured with sensors including: three orthogonal accelerometers, three orthogonal magnetometers, and three orthogonal rate gyroscopes, that all provide input(s) to the VGPMA or substitute processing system, such as that of the rotary steerable assembly. The processing system of this sensor input data then processes this information to calculate location and determine any potential misalignment errors. Optionally, sensor data and/or other data can be logged to memory.

The rate gyroscopes referenced in this embodiment are not used for inertial navigation; they are not the north-seeking gyroscopes that would be needed for inertial guidance nor are they gimbal mounted. They measure rotation rates of the bha along each axis of the tool coordinate system for the determination of parameters pertaining to drilling dynamics and kinematics. The z-axis gyroscope measures instantaneous rotation rate of the tool about the z-axis to identify and correct for bit stick slip motion and zones of magnetic interference. The x-axis and y-axis gyroscopes give an indication of the motion of the tool in response to shock and vibration while drilling. Namely, if the movement of the BHA due to shock is translational, then the x and y gyroscopes will not read any relative rotation. However, if the x and y gyroscopes sense a rotational component of BHA movement that correlates with the y-axis and x-axis accelerometers respectively, then it means that the response of the tool to shock and vibration includes pitch and yaw in the hole and that the motion includes a pendulum-like component. This motion could identify a false indication of borehole tilt so that it could be properly identified as the tool tilting in the hole and not tilting of the hole.

The electronic instrumentation and processing for tool steering control incorporates multiple feedback sensors, navigational sensors and a microcontroller and/or microprocessor assembly for processing the combined inputs from various sensors to steer the tool based on the sensor inputs, any pre-programmed control parameters, and/or additional control inputs communicated from the surface or other downhole systems. In an embodiment, the signal acquisition, noise reduction, and dynamic error correcting processing enables the accurate real-time computation of the instantaneous tool face measurements and BHA rotation rates and geostatic well bore trajectory parameters whether the tool is rotating or static, thereby eliminating the need for a geostationary or near geostationary platform for the navigational sensors, and enabling immediate and instantaneous well bore course corrections without interruption and transparent to the drilling process. Further, it is a well known technique to place two similar measurements separated by a known spacing, e.g., inclination, to dynamically compute and monitor the instantaneous dog leg severity so that preemptive adjustments to the build rate can be made on-the-fly without interrupting rotary drilling and steering operations, and without having to downlink depth and/or ROP information from the surface and without a surface generated command. In addition or alternatively, strain gauges can be used to determine the dog leg severity based on the amplitude of the fully reversed bending of the drill collar as it rotates in or through the curved section of the well.

Additionally, in an embodiment, the electronics and control instrumentation of the rotary steerable drilling tool can be combined with a downlink channel from the surface to the down-hole tool which allows for updating the tool and/or re-programming the tool from the surface so as to adaptively establish or change the desired target values of well bore azimuth and inclination while continuing to rotate and/or steer. In addition to the required navigational instrumentation, in an embodiment, the tool may incorporate instrumentation for various formation evaluation measurements such as average and/or quadrant natural gamma ray detection, multi-depth formation resistivity, density and neutron porosity, sonic porosity, borehole resistivity imaging, look ahead and look around sensing, an ultrasonic caliper measurement of wellbore diameter, and drilling mechanics. The electronic non-volatile memory, in an embodiment of the on-board electronics of the tool, is capable of logging and retaining and/or logging and transmitting, or simply transmitting in realtime or on a delay using buffer memory, a complete set of wellbore surveys and other data to enable geological steering capability so that the rotary steerable drilling tool can be effectively employed for drilling all sections of the well with a given diameter. When located below a positive displacement mud motor, real-time data from the rotary steerable tool can be wirelessly short-hop telemetered to a suitable remote receiver tool located above the mud motor and then telemetered to the surface via mud pulse, electro magnetic ("EM"), or other telemetry as may become available. In an embodiment, electrical power for control and operation of the solenoid valves and instrumentation, acquisition, and short-hop telemetry electronics is provided by down-hole batteries, or a mud turbine powered alternator, or a combination of the two. Additionally, the system can be powered by other downhole power generation systems.

BRIEF DESCRIPTION OF THE DRAWINGS

FIGS. 3A-1, 3B-1, 3C-1, and 3D-1 illustrate an embodiment of a rotary steerable drilling tool and show a sequence of orthogonal side views of the bit attachment to the rotary steerable drilling tool as the tool is dynamically dropping angle.

FIGS. 3A-2, 3B-2, 3C-2, and 3D-2 illustrate an embodiment of a rotary steerable drilling tool and show the drill bit of the rotary steerable drilling tool shown in FIGS. 3A-1, 3B-1, 3C-1, and 3D-1 respectively from the perspective of an observer looking towards the bit from downhole and defines a Cartesian coordinate system for reference.

FIG. 6A is locked. FIG. 6B is unlocked.

DETAILED DESCRIPTION OF THE PREFERRED EMBODIMENTS

Figure 1:
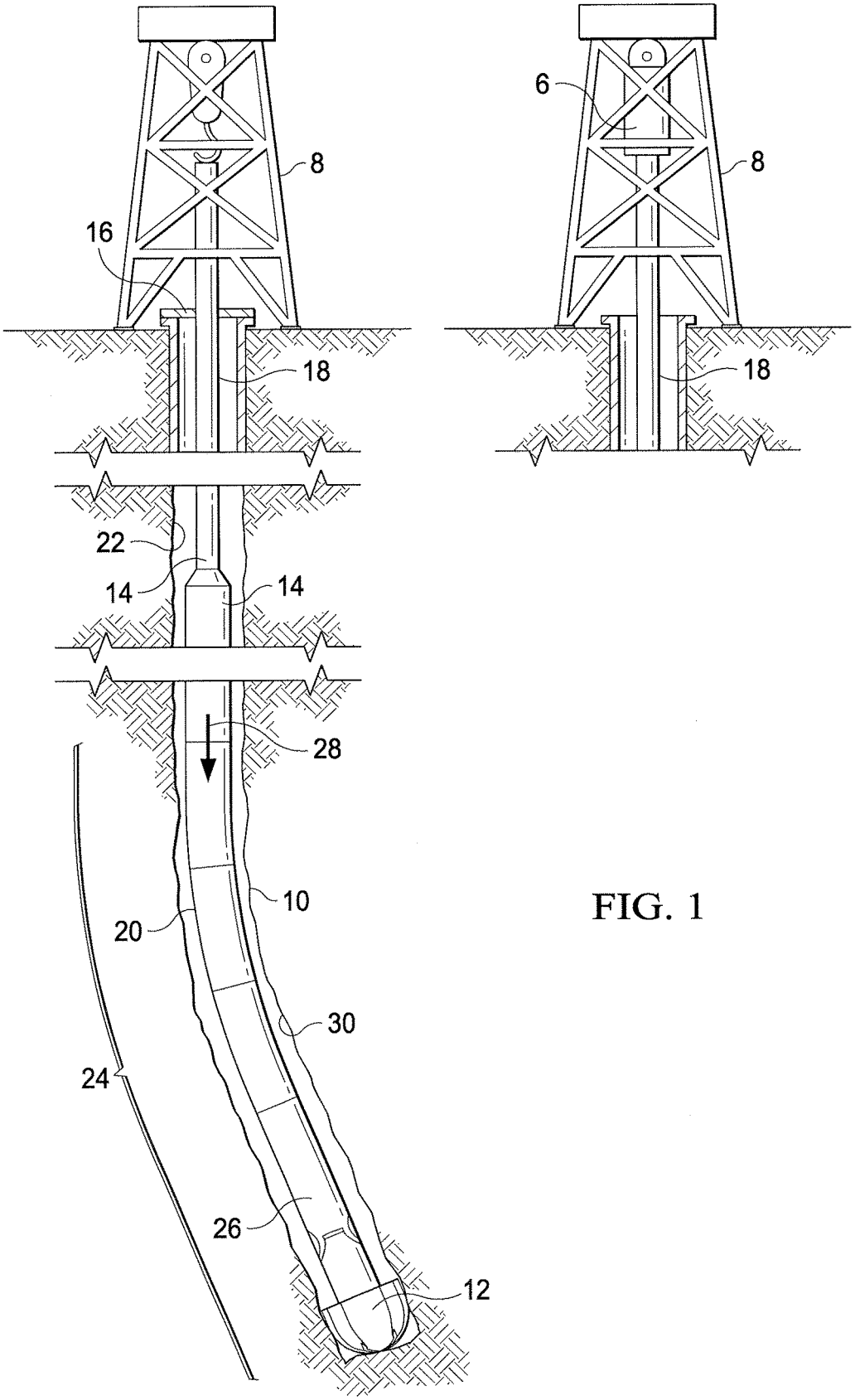
FIG. 1 illustrates a side perspective view of a deployed rotary drill bit string having a bottom hole assembly ("BHA").

Referring to FIG. 1, a wellbore 10 is shown being drilled by a rotary drill bit 12 that is connected at the lower end of a drill string 14 that extends upwardly to the surface where it is driven by the rotary table 16 or a top drive 6 of a typical drilling rig 8. The drill string 14 typically is comprised of sections of drill pipe 18 connected to a bottom hole assembly (BHA) 28 having one or more drill collars 20 connected therein for the purpose of applying weight to the drill bit 12. The wellbore 10 of FIG. 1 is shown as having a vertical or substantially vertical upper section 22 and a deviated, curved or horizontal lower section 24 which is being drilled under the active control of the rotary steerable drilling tool shown generally at 26 which is constructed in accordance with one aspect of the present invention. As will be described in detail below, the rotary steerable drilling tool 26 is constructed and arranged to cause the drill bit 12 to drill along a curved path that is designated by the control settings of the rotary steerable drilling tool 26 according to the principles disclosed herein. Drilling mud is pumped down the inside of the drill string 14, flows through the BHA 28, and out of jets in the bit 12, and returns to the surface with the drill cuttings in the annulus 30. The BHA 28 includes a drill bit 12 connected directly to the bottom of the actively controlled rotary steerable drilling tool 26. The BHA may also include other drilling tools such as positive displacement mud motors for controlling rotational speed and torque, and thrusters for controlling weight on bit. Moreover, the arrangement of these components within a drill string may be selected by drilling personnel based on their experience and preferences according to a wide variety of drilling characteristics, such as the turning radius of the curved wellbore section being drilled, the characteristics of the formation being drilled, the characteristics of the drilling equipment being employed for drilling, and the depth at which drilling is taking place. Since the number of possible combinations and permutations of these other collars is large, they will not be enumerated in this disclosure. Suffice it to say that the placement and arrangement of these additional components in the drill string relative to the actively controlled rotary steerable drilling tool 26 has no bearing on the construction and principles of operation of the present invention.

Figure 2A:
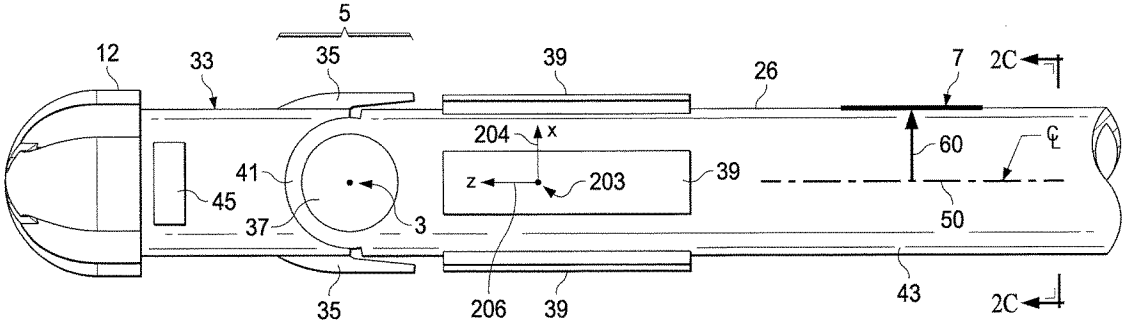
FIGS. 2A and 2B illustrate an embodiment of a rotary steerable drilling tool and show two orthogonal side views of the bit attachment to the rotary steerable drilling tool.
Figure 2B:
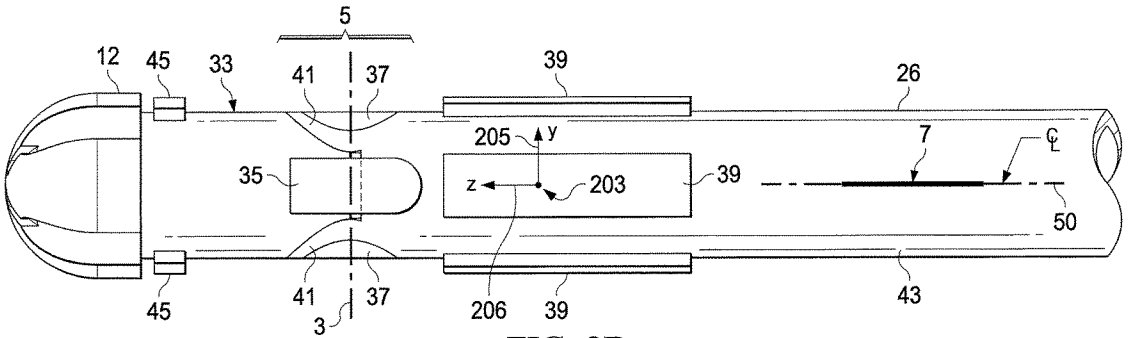
Figure 2C:
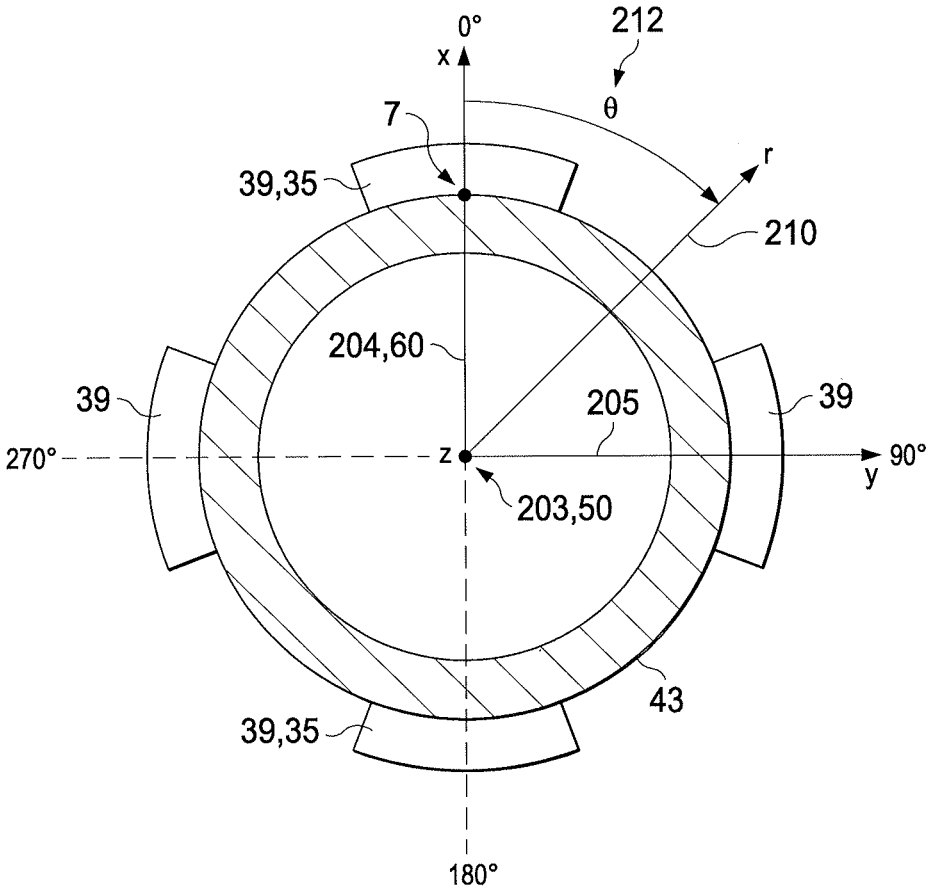
FIG. 2C illustrates an embodiment the drill bit of the rotary steerable drilling tool shown in FIGS. 2A and 2B from the perspective of an observer looking towards the bit from uphole and defines a Cartesian coordinate system for reference.

FIGS. 2A and 2B illustrate an embodiment of the rotary steerable drilling tool 26 ("RSDT") and show two orthogonal side views of the bit 12 attachment to the RSDT. A fixed point of reference on the RSDT called a scribe line 7 may or may not be visibly marked on the drill collar of the RSDT. Whether visibly marked or not, the scribe line is fixed with respect to and rotates with the mechanical and electronic features of the rotary steerable drilling tool and serves as a spatial reference point for calculations performed by the steering system. For this discussion, it will be useful to define a 3-dimensional reference Cartesian coordinate system, shown in FIG. 2C, from the perspective of an observer looking downhole towards the bit, which is attached to and rotates with the rotary steerable drilling tool. The origin 203 of the reference Cartesian coordinate system is the point of intersection of the centerline 50 of the RSDT and the x and y axes. The x-axis 204 passes through the origin 203 and orthogonally intersects the scribe line 7. The y-axis 205 is orthogonal to the x-axis and parallel to the hinge 5 axis of articulation 3. Consistent with industry standard nomenclature, the z-axis 206 shown in FIGS. 2A and 2B, is collinear with the centerline 50 of the RSDT and is positive in the down hole direction with increasing measured depth and negative in the up hole direction with decreasing measured depth. The polarity of the y-axis 205 is chosen so that the x, y, & z axes always form a right handed coordinate system. The unit vectors $I_x$, $I_y$, and $I_z$ satisfy the following vector product relationships: $I_x \otimes I_y = I_z$; $I_y \otimes I_z = I_x$; and $I_z \otimes I_x = I_y$. Referring to FIG. 2A, we can define a straight line segment parallel to the x-axis that extends from and is perpendicular to the centerline 50 of the RSDT and terminates on the scribe line 7, forming a tool orientation vector 60. When the tool is rotating in a well bore that is non-vertical with respect to the earth's gravitational field, the instantaneous GTF of the RSDT is said to be "0°" or "up" when the vertical component of the tool orientation vector 60 is pointing in a direction opposite to the earth's gravity vector. Conversely, when the tool is rotating in a well bore that is non-vertical with respect to the earth's gravitational field, the instantaneous GTF of the RSDT is said to be "180°" or "down" when the vertical component of the tool orientation vector 60 is pointing in the same direction as the earth's gravity vector.

Referring again to FIG. 2C, it is useful to define a tool cylindrical coordinate system that is attached to and rotates with the rotary steerable drilling tool. The z-axis 206 remains the same as defined for the 3-D Cartesian coordinate system. Looking at the AA cross-sectional view in FIG. 2A, the x and y axes are replaced with radius r 210 and angle θ (theta) 212. When describing a point on the tool, its radius "r" is equal to $(x^2+y^2)^{1/2}$. The angle θ is defined relative to the scribe line 7 and is zero degrees at the scribe line and positive in the clockwise direction when viewed looking in the direction of +z in the downhole direction.

Referring to the embodiment of the RSDT illustrated in both FIGS. 2A and 2B, the bit assembly is attached at the bottom end of the RSDT by means of a single axis hinge assembly 5, comprised of a yoke 41 that is preferably integral with the rotary steerable drilling tool collar 43, the bit shaft 33 that screws into the bit 12 on its lower end and mates with the yoke 41 at its upper end, and a hinge pin 37 that fits into the yoke 41 and the upper end of the bit shaft 33. As shown in both FIGS. 2A and 2B, the orientation of the hinge pin 37 is parallel to the y-axis 205 of the tool reference Cartesian coordinate system, making it perpendicular to both the tool orientation vector 60 and the centerline 50 of the RSDT. The tool orientation vector 60 would be in the direction of 0° in the tool cylindrical coordinate system. The hinge 5 allows the bit shaft 33 to articulate with a single degree of freedom with respect to the rotary steerable drilling tool collar 43 about the hinge 5 axis of articulation 3.

This is in contrast to point-the-bit systems that employ multi-degree-of-freedom omnidirectional pivots or universal joints so that the deflection of the bit can be maintained constant with respect to a geostationary coordinate system (a coordinate system that does not rotate with the tool but is referenced to the earth) as the tool rotates. As will be discussed below in more detail, changing the direction of the well bore in a particular direction using this aspect of the present invention is effected by the spatially phased coherent symmetrical bidirectional reciprocations of the bit shaft 33 and drill bit 12 as the actively controlled RSDT rotates.

A pair of stabilizer blades 35 can be either integral with or can be welded onto the bit shaft 33 at $\theta_{212}$=0° and 180° on the bit shaft, extending above the hinge pin 37 to improve the steerability of the RSDT. Additionally, it may be useful to add a pair of full gauge stabilizer blades just above the bit with the blades centered at $\theta_{212}$=90° and 270° to further improve the steerability of the RSDT. One or more fixed stabilizer blades 39 can be positioned and mounted on the outer diameter of the RSDT collar 43 above the hinge as needed for BHA stability and steerabilty. The stabilizer blades 39 can be either straight bladed or curve bladed, cylindrical or watermelon shaped, consistent with the intended build rates and down hole drilling characteristics desired by drilling personnel.

The tool "snapshots" in FIGS. 3A thru 3D show a sequence of 4 side and bottom-up end views as the RSDT is being rotated and steered for the scenario where the well bore is dropping angle, i.e., the "front side" of the curve is down. The drill collar above the hinge is labeled 43 and rotates on the tool centerline 50. The instantaneous GTF orientation of the tool in each figure is identified by the location of the scribe line 7 and the tool orientation vector 60. For the sake of clarity, the deflection of the bit shaft is exaggerated and the stabilizer blades are not shown.

The direction of rotation in each figure is clockwise when viewed from the surface and is shown by the curved arrows that are labeled with the symbol "W" (omega). As the RSDT rotates, the bit shaft 33 and bit 12 deflect relative to the tool center line 50. For convenience, the axes of the tool reference Cartesian coordinate system are superimposed on each picture. The z-axis 206 is collinear with the centerline of the tool 50. The x-axis 204 and y-axis 205 are both transverse to the tool centerline 50. For this discussion, the origin of the reference coordinate system 203 is shown at the intersection of the z-axis 206, the x-axis 204, and the hinge axis of articulation 3. The hinge axis of articulation 3 is collinear with the y-axis 205. The deflection of the bit relative to the center line 50 of the RSDT rotation is labeled by the Greek letter delta (6), which is the angle formed by the long axis 85 of the bit shaft 33 and the centerline 50 of the RSDT. The sign convention of the angle δ is negative when the bit shaft 33 deflects away from the scribe line 7 and is positive when the bit shaft 33 deflects towards the scribe line 7. The GTF angles 0°, 90°, 180°, and 270° are labeled on the bottom end view in each figure. These angles are fixed relative to the earth's gravity vector and do not rotate with the tool.

Figures 1, 3A:
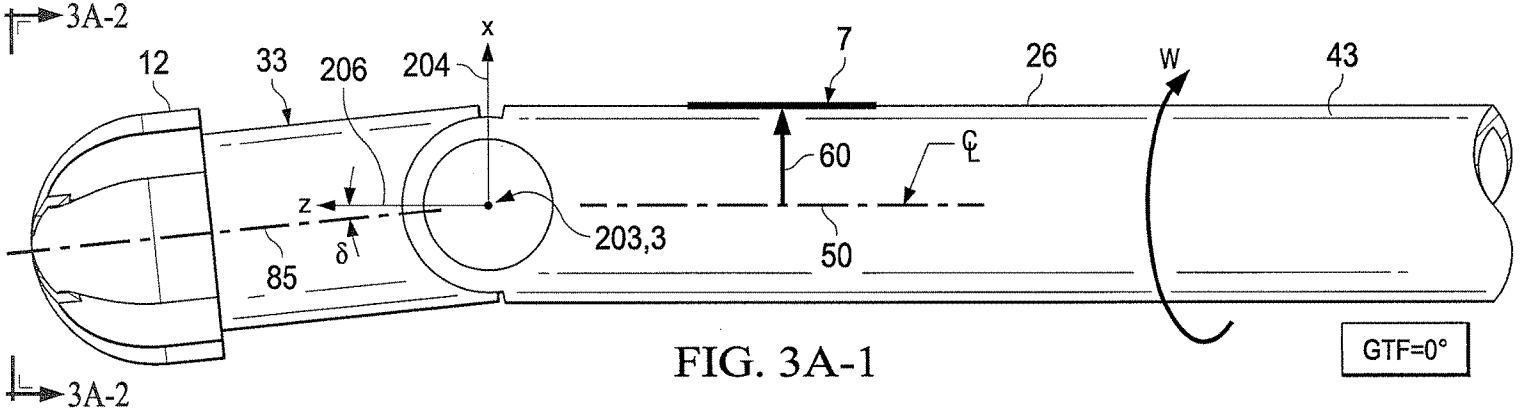
Figures 2, 3A:
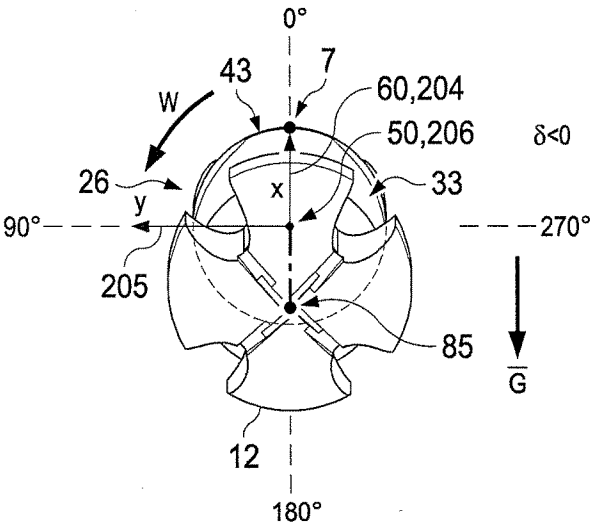
Figures 1, 3B:
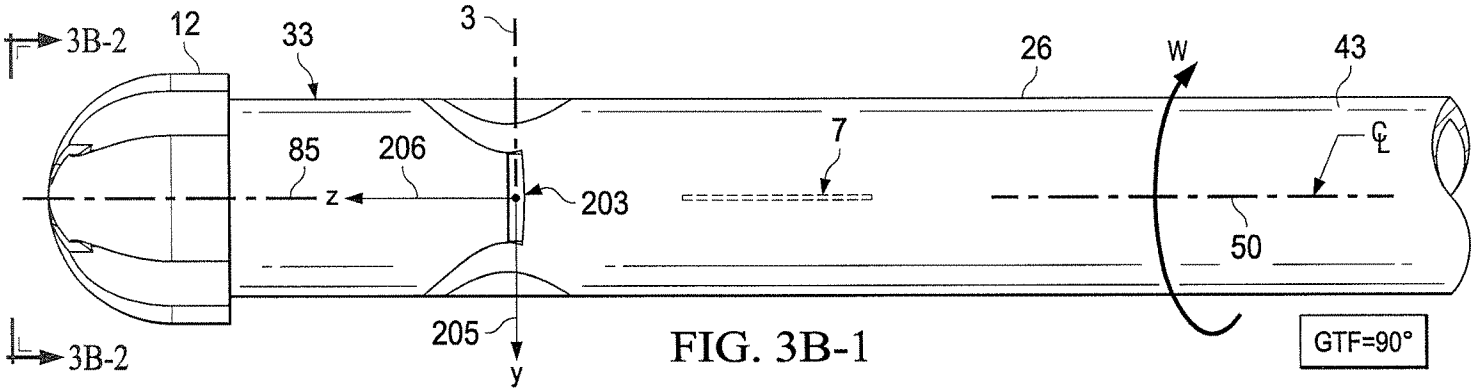
Figures 2, 3B:
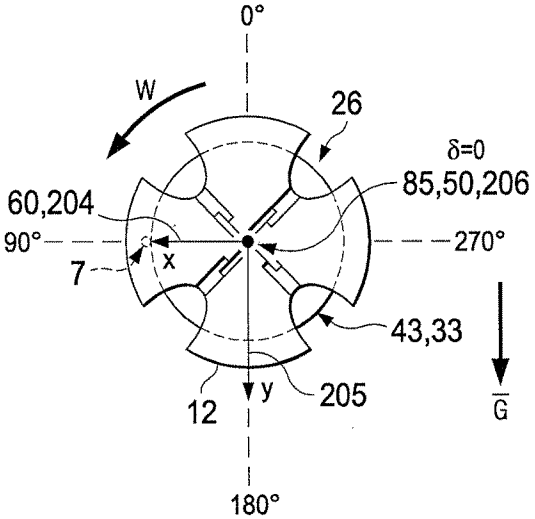
Figures 1, 3C:
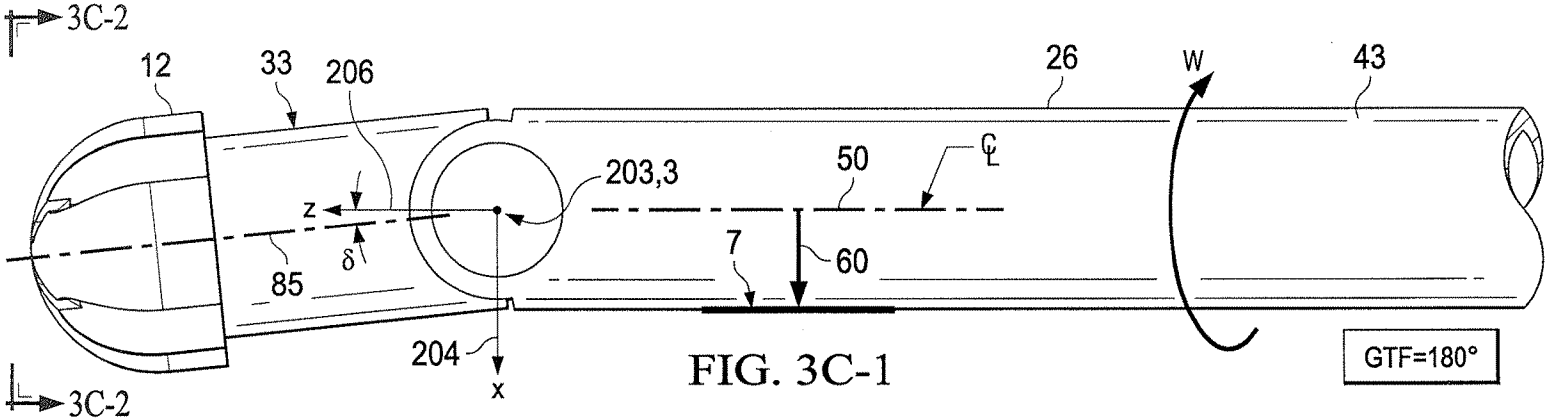
Figures 2, 3C:
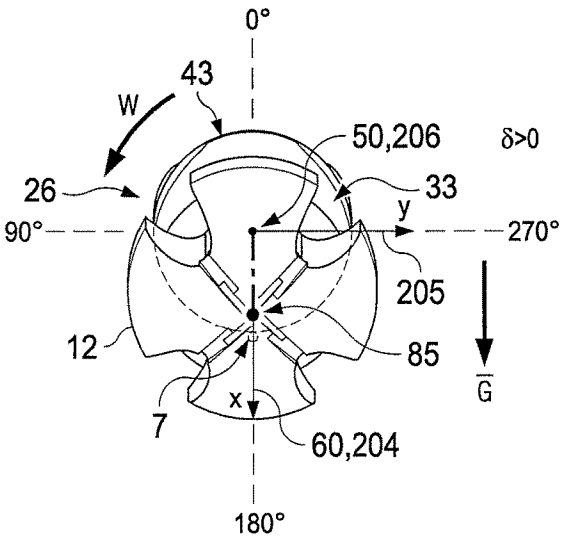

In FIG. 3A, the scribe line 7 is "up," and the GTF is 0°. In FIG. 3C, the scribe line 7 is "down," and the GTF is 180°. The directions of "right" and "left" are defined from the driller's perspective, opposite to the end views shown in FIGS. 3B and 3D. In FIG. 3B, the scribe line 7 is at 90°. A GTF equal to 90° is referred to as "right" since bit deflections in that direction will cause the borehole to make a right turn. Similarly for FIG. 3D, the scribe line 7 is at 270°, which is referred to as "left" since bit deflections in that direction will cause the borehole to make a left turn. FIG. 3A shows the long axis 85 of the bit shaft 33 deflected away from the scribe line 7 by some negative angle δ, but since the scribe line GTF is 0°, the drill bit 12 preferentially removes material on the low side of the hole. The snapshot in FIG. 3C is taken after the RSDT has rotated 180° from its orientation in the snapshot in FIG. 3A and shows the long axis 85 of the bit shaft 33 deflected towards the scribe line 7 by some positive angle δ, but since the scribe line GTF is 180° (pointing down), the drill bit 12 again preferentially removes material on the low side of the hole.

Figures 1, 3D:
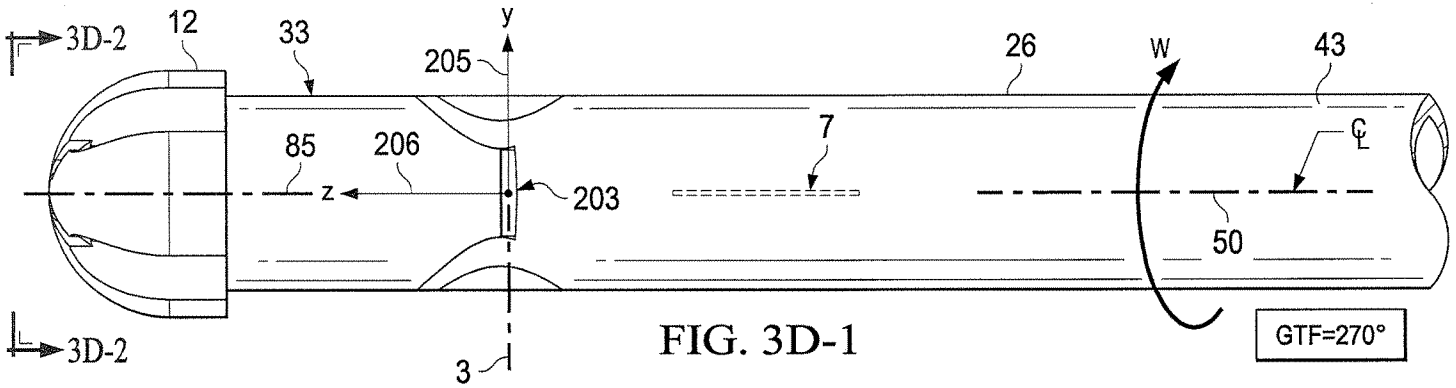
Figures 2, 3D:
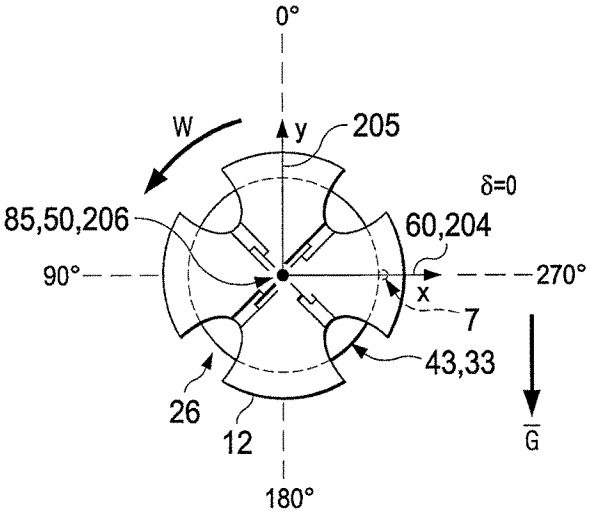

The snapshots in FIGS. 3B and 3D show the long axis 85 of the bit shaft 33 aligned with the centerline 50 of the RSDT. In this position the bit 12 makes momentary contact with the "back side" diameter of the hole and hence removes less material from the "back side" diameter of the hole during steering operations than it normally would when drilling straight ahead. When steering is activated and the RSDT is rotating, this symmetrical reciprocating motion of the bit 12 at the same frequency as the rotation of the BHA, synchronously phased relative to the spatial direction in which the well bore is being steered is a unique aspect of the method and apparatus of the present invention.

Figure 4A:
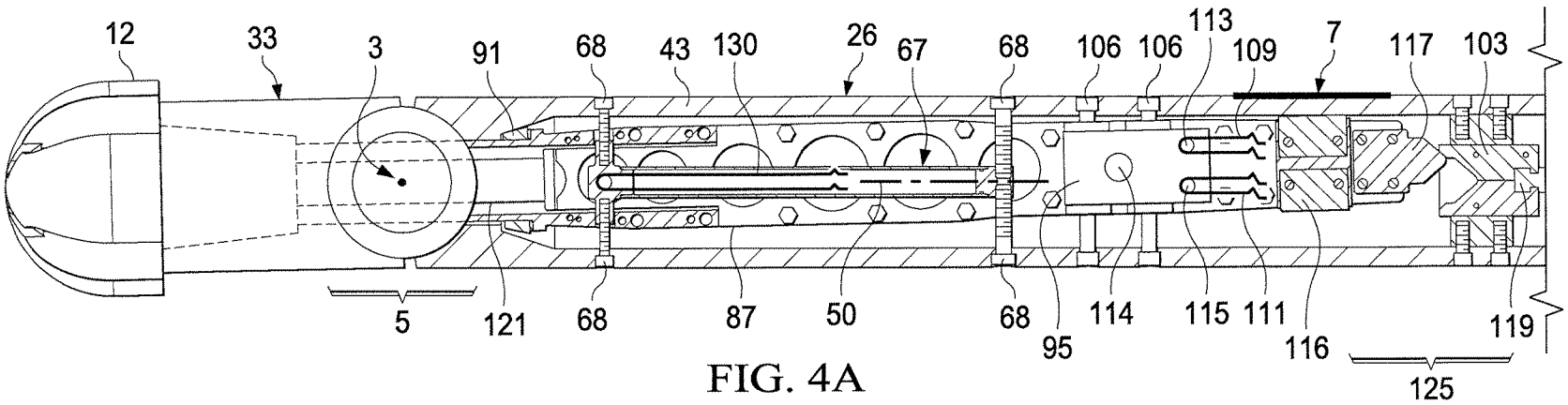
FIGS. 4A-4B show a cut-away side perspective view illustrating the internal structure of an embodiment of the rotary steerable drilling tool and show two views of the reciprocating motion of the bit and bit shaft.
Figure 4B:
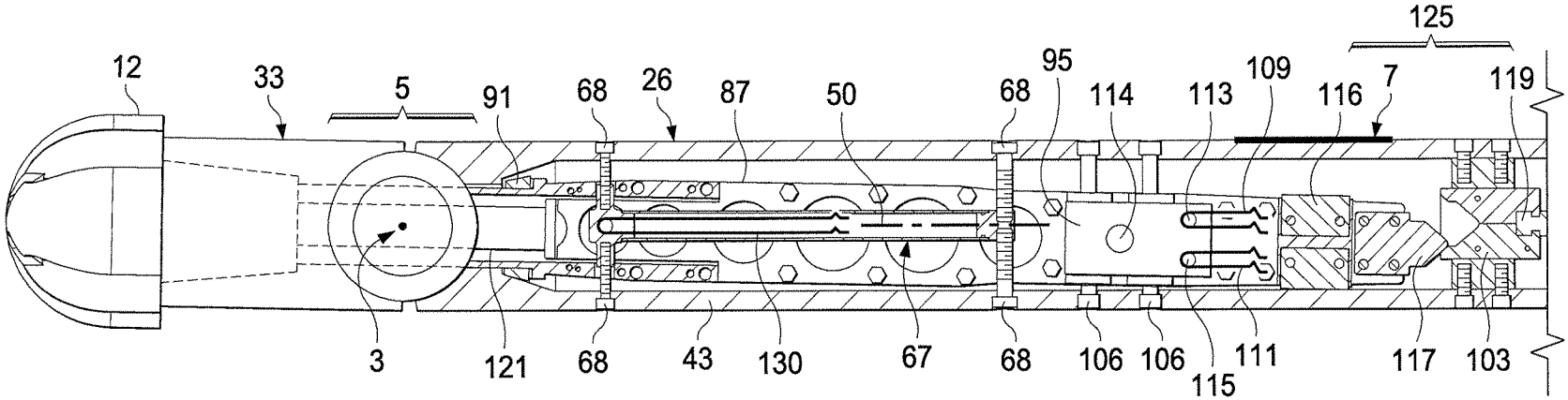

In an embodiment of the RSDT, the reciprocating motions of the bit 12 and bit shaft 33 can be actuated by the mechanism shown in FIGS. 4A and 4B. A lever arm 87 is attached to the bit shaft 33 at the hinge 5 by a lower extension 121 of the lever arm 87 that engages a centerline hole through the middle of the bit shaft 33 that is orthogonal to the hinge pin axis of articulation 3. An elastomeric mud seal 91 at this connection is provided to prevent drilling fluid from escaping around the lever arm extension 121 as it engages the hinge 5. The lever arm extension 121 includes its own centerline hole that is open to the centerline hole in the bit shaft 33 to permit the passage of drilling mud to reach the bit 12 and the nozzles in the bit. In this embodiment, the lever arm 87 is comprised of two parallel rails and numerous spacers and fasteners that are joined to the lower end extension 121. In FIG. 4A, as the lever arm 87 is angularly displaced towards the scribe line 7, the bit 12 and bit shaft 33 will angularly displace in the opposite direction away from the scribe line 7 by means of the action of the hinge 5. Conversely, in FIG. 4B, as the lever arm 87 is angularly displaced away from the scribe line 7, the bit 12 and bit shaft 33 will angularly displace in the opposite direction towards the scribe line 7 by means of the action of the hinge 5. In this embodiment, the angular displacement of the lever arm 87 is actuated by a hydraulic servo piston assembly 95, although other means could be used such as an axial hydraulic servo piston with a linkage, an electrical actuator with or without a linkage, or a drilling mud piston. All such variations are within the scope of this invention. The angular displacement of the bit 12 is equal and opposite to the angular displacement of the lever arm 87 by means of the action of the hinge. The maximum angular displacement of the bit 12 is limited by the maximum angular displacement of the lever arm 87 which is limited by the maximum displacement of the lever arm actuating servo piston assembly 95.

The embodiment shown in FIGS. 4A and 4B includes an electronics housing 67 that contains the dynamic navigational sensors and acquisition electronics located between the two parallel rails of the lever arm 87. The centerline of the housing is collinear with centerline 50 of the collar 43 and fixedly mounted to the collar 43 by means of mechanical supports 68. Electrical connections are provided by means of a wire tube 130 that runs from an upper electronics chamber (not shown) down to the lower end of the electronics housing 67. The housing rotates with the collar and does not counter rotate or reciprocate with the movements of the lever arm 87. In this embodiment, no part of the tool, mechanical or electronic, counter rotates with respect to the rotation of the RSDT, although such counter-rotation of certain components is not prohibited by this aspect of the present invention.

Figure 5:
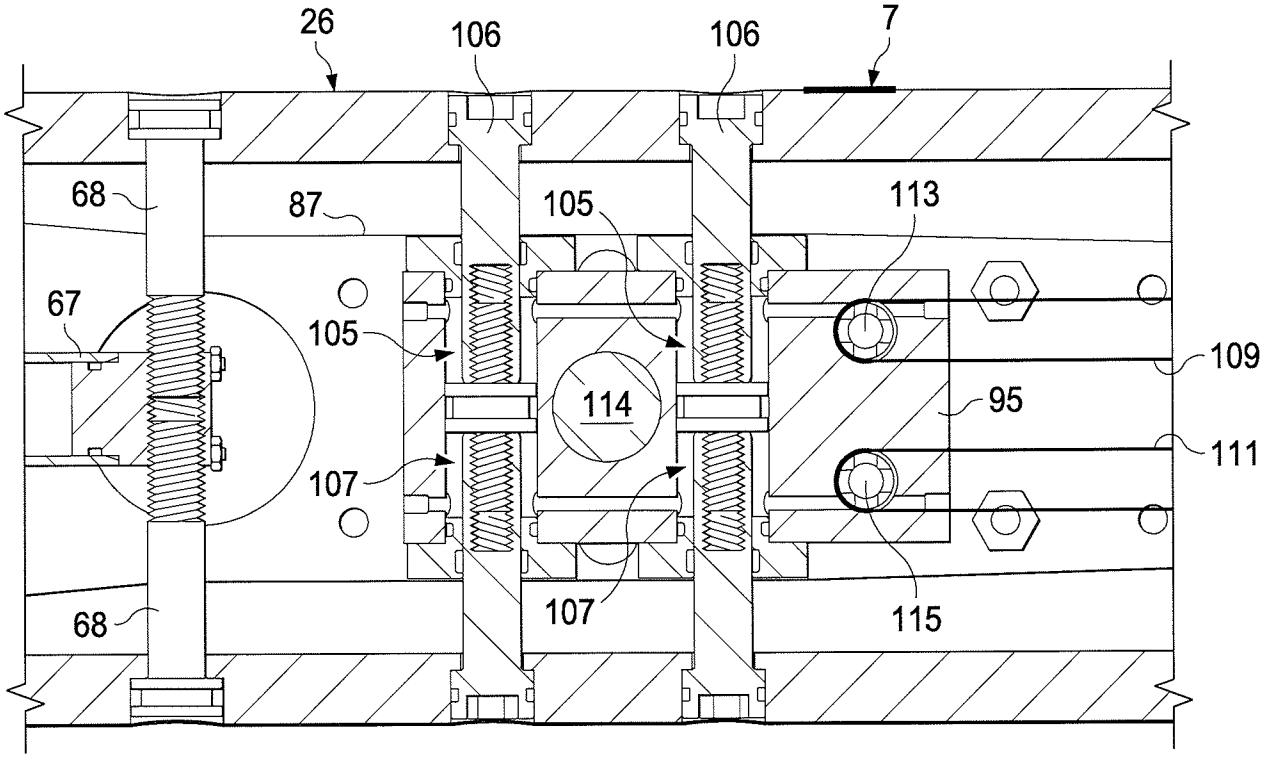
FIG. 5 shows an enlarged section of the lever arm actuator of the rotary steerable drilling tool shown in FIGS. 4A-4B.

FIG. 5 shows a detailed view of the lever arm 87 actuating servo-piston assembly 95. This embodiment is shown with two pistons 106 hydraulically connected in parallel to minimize the cross-sectional area presented to the mud flow through the RSDT, to further balance the forces on the pivot attachment 114 to the lever arm 87, and to conveniently package the assembly into the available volume. A single servo-piston could be used, provided enough actuating force can be achieved given the operating limits of the hydraulic system, namely the maximum flow rate and output pressure while fitting the servo piston into the available volume. There are two upper chambers 105 and two lower chambers 107. The upper chambers 105 are hydraulically connected to the power source via hydraulic swivel 113 and hydraulic tubing 109. The lower chambers 107 are hydraulically connected to the power source via hydraulic swivel 115 and hydraulic tubing 111. When high pressure hydraulic fluid from the pump (not shown) and control valves (not shown) is connected to the lower piston chambers 107, and the upper piston chambers 105 are connected to the low pressure hydraulic tank/reservoir 75 (not shown), then the housing of the piston assembly 95 will move downwards, causing the end of the lever arm to move downwards away from the scribe line 7 and causing the bit to deflect upwards towards the scribe line 7. Conversely, when high pressure hydraulic fluid from the pump (not shown) and control valves (not shown) is connected to the upper piston chambers 105, and the lower piston chambers 107 are connected to the low pressure hydraulic tank/reservoir 75 (not shown), then the housing of the piston assembly 95 will move upwards, causing the end of the lever arm to move upwards towards the scribe line 7 and causing the bit to deflect downwards away from the scribe line 7. Once the maximum angular deflection of the bit assembly has been determined by design, then the placement of the piston assembly 95 with respect to the hinge axis 3 (FIGS. 4A and 4B) and the allowable travel of the piston assembly can be selected to limit the corresponding maximum angular displacement of the bit 12.

Figure 6A:
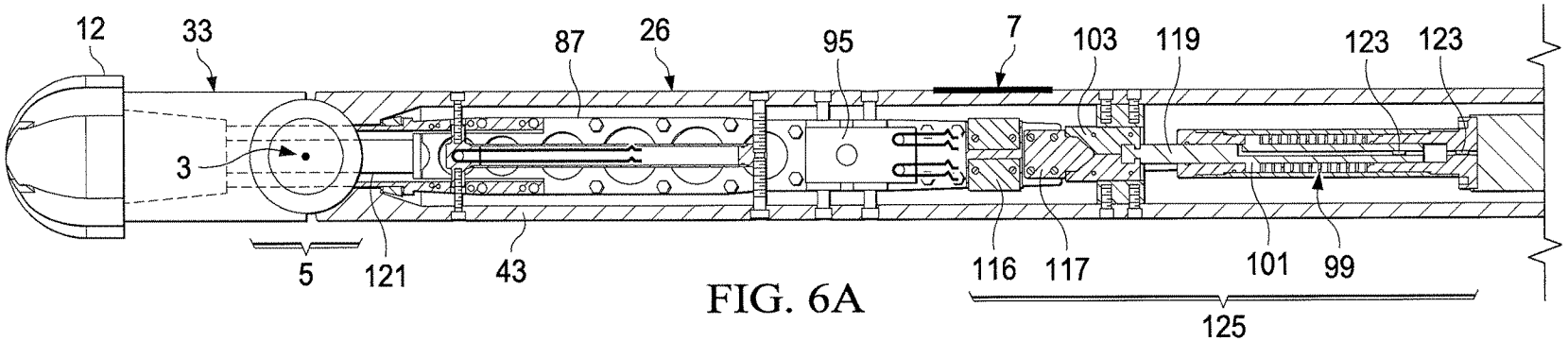
FIGS. 6A-6B show a side perspective view illustrating the internal structure of an embodiment of the rotary steerable drilling tool and show two views of the operation of the lever arm locking mechanism that is used to lock the bit in the centered position when steering operations are not active.
Figure 6B:
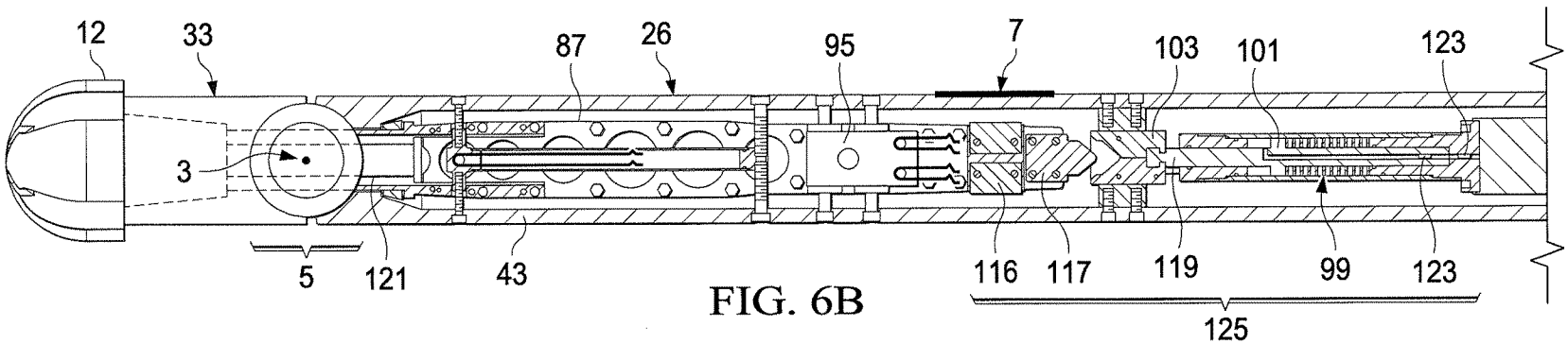

FIGS. 6A and 6B, show the operation of the lever arm 87 locking mechanism 125 that can be used to lock the bit in the centered position when steering operations are not active. The lever arm 87 terminates with a wedge assembly comprising a mounting bracket 116 and a male wedge 117. A ram assembly comprises a female ram 103, a shaft 119, a piston 101 and a spring 99. The chamber housing the spring 99 is hydraulically connected to the tank. The high pressure side of the piston 101 is hydraulically connected to the high pressure fluid by means of a hydraulic channel 123.

FIG. 6A shows the case when steering is disabled and the wedge 117 is mechanically engaged by the ram 103 and held in position by the spring 99. This corresponds to the case where the system hydraulic pressure is low allowing the spring 99 to force the female ram 103 into engagement with the male wedge 117. This mechanically locks the lever arm 87 in the centered position and prevents it from moving. FIG. 6B shows the case where steering is enabled. As the hydraulic operating pressure increases, high pressure hydraulic fluid flows through passageway 123 retracting the piston 101, compressing the spring 99, and disengaging the female ram 103 from the male wedge 117, thereby allowing reciprocating movement of the lever arm 87.

FIG. 6B corresponds to the case where the lever arm 87 is free to move but is momentarily actively being held in the centered position by the steering control system of the RSDT in preparation for the commencement of steering operations. FIGS. 4A and 4B show the case where active steering is enabled and the lever arm 87 is shown in an angularly deflected position during active steering operations. If the lever arm 87 is not being actively steered by the operation of the RSDT, then the lever arm 87 will be in the locked position as shown in FIG. 6A. As a failsafe, if the hydraulic operating pressure in line 123 decreases below the threshold set by the spring 99 for any reason, then the locking ram 103 engages the wedge 117 and returns the bit 12 to the locked and centered position.

Figure 7A:
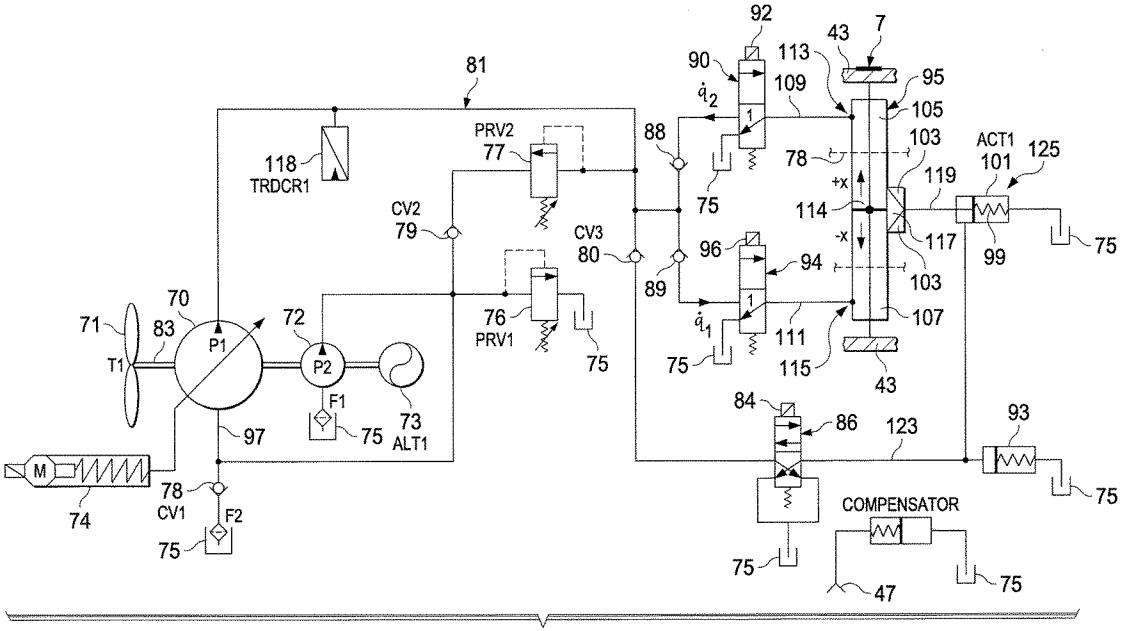
FIGS. 7A-7D illustrate an embodiment for actuating the bit of a rotary steerable drilling tool.

FIGS. 7A through 7D show a hydraulic embodiment for actuating the bit motions while steering and the method associated with that embodiment. FIG. 7A is a schematic of the hydraulic system of the RSDT. Power is provided by a drilling mud powered turbine 71 mounted on a drive shaft 83, which is connected to a dynamically variable displacement axial piston pump 70, a small charge pump 72, and a small electrical alternator 73. The displacement of the dynamically variable displacement axial piston pump 70 is dynamically controlled by means of an axial piston pump actuator 74 that controls the angle of an internal non-rotating swash plate relative to the axis of the drive shaft rotation. The displacement per drive shaft revolution of the dynamically variable displacement axial piston pump 70 is controlled by the angle of the swash plate. At zero degrees, the displacement of the pump is essentially zero cc/rev. The maximum displacement of the pump will be achieved when the swash plate is at its maximum allowable angle. A charge pump 72 draws hydraulic fluid from the reservoir 75 via a filter F1 and provides a minimum flow to the dynamically variable displacement axial piston pump 70 via the low pressure inlet line 97. Once primed, the dynamically variable displacement axial piston pump 70 will draw additional fluid from the hydraulic reservoir 75 through a filter F2 and the check valve 78 and the low pressure inlet line 97. The dynamically variable displacement axial piston pump 70 simultaneously accomplishes two important functions, namely, to dynamically regulate the amount of hydraulic power being provided to the system from the mud powered turbine 71, and to dynamically regulate the amount of power being provided to the lever arm actuating piston assembly 95. The swash plate angle will be adjusted to compensate for changes in either drive shaft 83 rotation speed or the pump 70 output flow rate required to actuate the steering motion of the bit 12. The drilling mud powered turbine 71 is designed to handle a practical range of mud flow rates determined by the driller and tool pusher. This requires the tool to function at a minimum flow rate and minimum mud weight with full power, which means that with a hypothetical fixed displacement pump, there would be an excess of power at the maximum flow rate and maximum mud weight. Since the axial piston pump 70 is specifically designed for the purpose of input and output power regulation, as the available turbine 71 input power increases, the swash plate of the axial piston pump 70 can be adjusted to generate only the power that is demanded by the tool, and hence, no excess power will be generated by the axial piston pump 70. Excess power must be dissipated as heat without doing any useful work. As the flow rate and/or mud weight increases, the swash plate angle dynamically decreases to generate only the power required for any given load. On the discharge or load side of the pump, the hydraulic power required by the load is determined by the BHA rpm and the required amplitude of the bit deflections during steering operations. If the power demanded by the RSDT dynamically increases, the angle of the swash plate will be dynamically increased by actuator 74 in response to control signals from the steering control processor.

When steering is disabled, the power required from the pump is essentially zero watts mechanical equivalent power; and the swash plate angle of the pump 70 will be close to zero degrees. In this state, the valve 86 is OFF and shunts the flow from pump 70 via hydraulic line 81 and check valve 80 to the tank 75. Valve 86 also connects the pressure line 123 to the tank 75, so that the lever arm locking mechanism 125 mechanically locks the lever arm 87 in the centered position, since the piston 101 provides no resistance to the spring 99, forcing the wedge 103 by means of the shaft 119 into mechanical engagement with the locking ram 117. During the transition time when steering operations are first being enabled, the control electronics sends a signal to the solenoid 84 of valve 86 changing it to the "ON" state and sends a signal to the swash plate actuator 74 to increase the angle of the swash plate, causing the output pressure of the pump in line 81 to increase which retracts the female ram 103 of lever arm locking mechanism 125 by activating the piston 101 and compressing the spring 99 retracting the shaft 119. At the same time, the valves 90 and 94 will both be activated by "ON" signals to solenoids 92 and 96, respectively. This applies the same pressure to both chambers 105 and 107 of the lever arm actuating piston assembly 95, momentarily hydraulically locking the lever arm in the center position by the action of check valves 88 and 89 that prevent the hydraulic fluid from transferring between the chambers 105 and 107. The steering motion of the bit commences once the timed signals to the valve solenoids 92 and 96 alternately open and close valves 90 and 94 as shown by curves 51 and 52 in FIG. 7B. (These curves will be explained in the discussion of FIG. 7B.) A high pressure accumulator 93 is provided to smooth out any transient pressure spikes that might be generated by the momentary switching of the valves 94 and 90; and together with the check valve 80, to be a local reservoir of high pressure to keep the lever arm locking mechanism 125 in the unlocked position until the valve 86 is turned "OFF" allowing the lever arm locking mechanism to engage the ram 103 with the wedge 117. In FIG. 7A, over-pressure relief is provided by relief valves 76 and 77. If the pressure in hydraulic line 81 exceeds the preset relief pressure of relief valve 77, the pressure will be relieved by venting fluid back to the inlet side of the axial piston pump 70 by means of the check valve 79 and hydraulic line 97. If the pressure on the inlet side of the axial piston pump 70 is too high, it will be relieved by venting fluid back to the tank 75 by means of the relief valve 76.

For a given input shaft 83 rotation rate, the amplitude of the bit deflections is proportional to the angle of the swash plate. This reveals another advantage of the dynamically variable displacement axial piston pump 70, namely, that the amplitude of the bit deflections can be dynamically reduced in response to the detection of stick-slip rotations of the bit 12 independent from the clocking of the valves 90 and 94. As the amplitude is being increased, if the incipience of stick-slip rotation is detected, the angle of the swash plate can be immediately reduced to alleviate or avoid the stick-slip condition, until the drilling parameters have been changed in response to a down hole drilling mechanics alarm that is transmitted to the surface. Yet another advantage of the axial piston pump 70 is that steering operations can be gradually phased in and out to avoid the formation of ledges in the borehole wall. By slowly increasing the swash plate angle of the dynamically variable displacement axial piston pump 70, the RSDT will smoothly transition from a straight hole section to a curved hole section by reverse feathering the amplitude of the deflections of the bit 12 in a controlled manner. When it is time to suspend steering operations, the angle of the swash plate will be gradually reduced to zero degrees causing the deflections of the bit 12 to feather back to zero in a controlled manner.

Figure 7B:
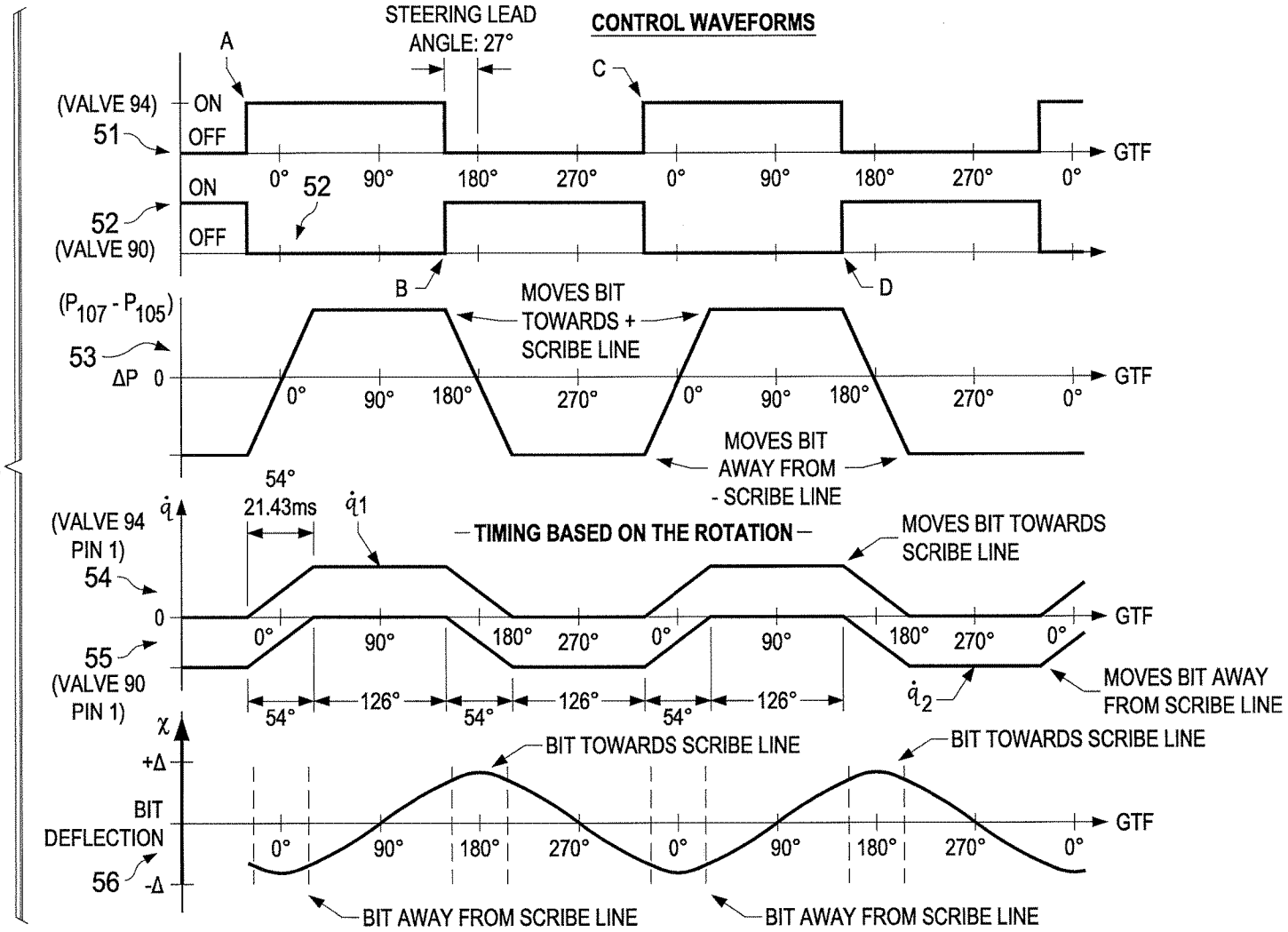

FIG. 7B shows a diagram of the preferred timing and waveforms that implement the method of phased synchronous symmetrical bidirectional reciprocating deflections of the bit 12 that are used by the RSDT, that is one aspect of the present invention. For the curves in FIG. 7B, the x-axis of each plot is GTF over the range of 0° to 360° for two consecutive rotations of the RSDT. The curves in FIG. 7B are consistent with the "dropping angle" scenario previously discussed and shown in FIGS. 3A through 3D. One of ordinary skill in the art should understand that the relative timing of the waveforms with respect to each other will remain the same for steering the well in other directions, only the spatial phasing of the waveforms relative to GTF (or MTF) will be different. However, for this example, the goal is to steer the well bore in the direction of the bottom of the hole or in the direction of a GTF equal to 180°. Additionally, a rotation rate of 420 RPM is implicitly assumed when it is necessary to convert the x-axis from GTF to time.

When steering the well, the modulation of the bit deflections is controlled by an onboard electronics control module (shown in FIG. 8) that repetitively and alternately activates the valves 94 and 90, by means of their respective solenoids 96 and 92. The onboard electronics control module will provide the correct spatial phasing of the solenoid control signals needed to steer the well in any desired direction. In FIG. 7B, curve 51 shows the control signal that drives the solenoid 96 to control valve 94. Curve 52 shows the control signal that drives the solenoid 92 to control valve 90. The y-axis of the plots of curves 51 and 52 assigns a logical value of 1 for ON and 0 for OFF. As previously stated, the x-axis of the plots of all curves in the figure is the instantaneous GTF of the scribe line 7 of the RSDT. The x-axis of the plots spans a range of about 800°, or slightly more than 2 full rotations of the RSDT. The curves 51 and 52 are logical complements and they each have a duty cycle of 50%. At points "A" and "C" valve 94 is being switched ON at the same time that valve 90 is being switched OFF. Conversely, at points "B" and "D" valve 94 is being switched OFF at the same time that valve 90 is being switched ON. When valve 90 is OFF and valve 94 is ON, chamber 107 of the lever arm actuating piston assembly 95 is pressurized causing the lever arm 87 to move away from the scribe line 7 thereby causing the bit 12 to move in the opposite direction towards the scribe line 7 or in the positive x-axis 204 direction of the RSDT coordinate system, shown on curve 56 between 0° and 180° GTF. Conversely, when valve 94 is OFF and valve 90 is ON, chamber 105 of the lever arm actuating piston assembly 95 is pressurized causing the lever arm 87 to move towards the scribe line 7 thereby causing the bit 12 to move in the opposite direction away from the scribe line 7 or in the negative x-axis 204 direction of the RSDT coordinate system, shown on curve 56 between 180° and 0° GTF. In this particular example of steering the well in the down direction, the positive bit deflections in curve 56 will be a maximum when GTF is equal to 180° or the scribe line is "DOWN," and the negative bit deflections in curve 56 will be a maximum when the GTF is equal to 0° or when the scribe line is "UP."

In FIG. 7B, curve 53 shows the differential pressure between the chambers 107 and 105, specifically, $\Delta P = P_{107} - P_{105}$. When $\Delta P$ is positive, the bit is being deflected in the direction towards the scribe line 7. When $\Delta P$ is negative, the bit is being deflected in the direction away from the scribe line 7. The amplitude of $\Delta P$ is determined by the dynamically variable displacement axial piston pump 70 flow rate and the frictional drag forces on the bit as it deflects and the RSDT rotates. Curve 54 shows the hydraulic fluid flow rate at pin 1 of valve 94. Curve 55 shows the negative of the hydraulic flow rate at pin 1 of valve 90. The valves 94 and 90 do not instantly switch from ON to OFF and from OFF to ON. Each valve takes a finite amount of time to transition from one state (ON or OFF) to the other state (OFF or ON).

This finite transition time must be taken into account by the onboard electronics control module by advancing the timing of the solenoid control signals by an amount equal to half the transition time. At 420 RPM, the transition for each valve requires about 54°, hence the control signals must lead the intended timing of the bit deflections by half that amount or by approximately 27°. For the maximum positive bit 12 deflection to occur at a GTF of 180°, the valves must be switched at a GTF of 153°. And for the maximum negative bit 12 deflection to occur at a GTF of 0°, the valves must be switched at a GTF of −27°. The amount of valve control lead angle will decrease linearly as RPM decreases. FIG. 7B demonstrates an advantage of using two independent 3-way 2-position valves to separately and simultaneously control each chamber of the lever arm actuating piston assembly 95: the transition time is cut in half by switching both valves 94 and 90 at the same time, compared with the switching transition time of a single 4-way 3-position valve with a core that must travel twice as far and take twice as long to switch.

Figure 7C:
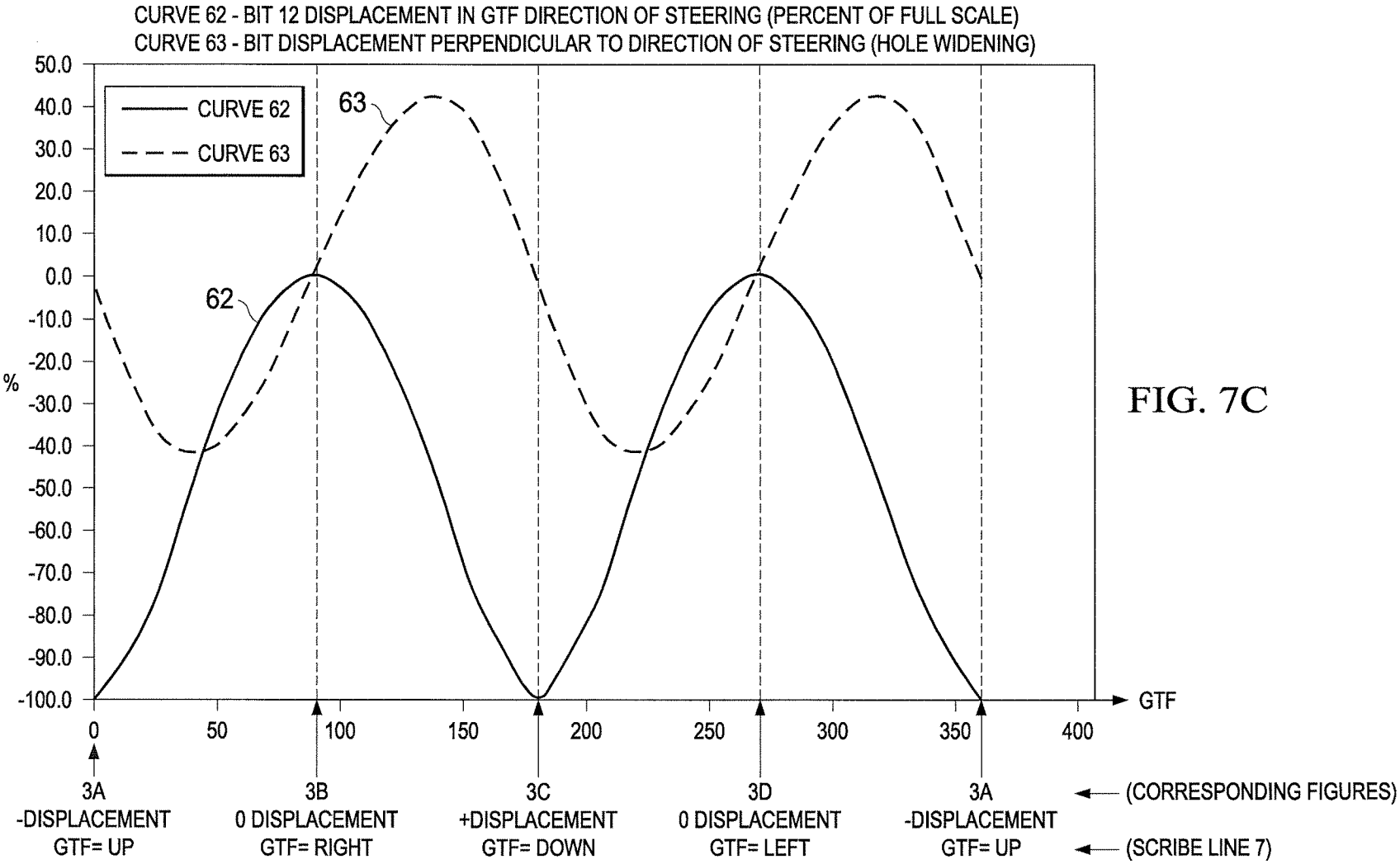

FIG. 7C shows two curves that represent the displacement of the bit as function of GTF for the "dropping angle" or "steering down" scenario illustrated by FIGS. 3A-3D. For the purposes of this discussion, the term "deflection" will specifically refer to the motion of the bit relative to the coordinate system that is fixed to and rotates with the tool. The x-axis of the graph shows the instantaneous angular orientation or GTF of the scribe line 7 of the RSDT. The y-axis of the graph shows the percent of maximum displacement of the bit in two orthogonal directions: in this case the vertical plane (curve 62) and the horizontal plane (curve 63). More generally, curve 62 shows the instantaneous displacement of the bit in the direction of steering, in this case, up and down. Curve 63 shows the instantaneous displacement of the bit in the direction perpendicular to the direction of steering of the bit, in this case, left and right. The "resultant bit displacement" is the vector sum of the coherent reciprocating deflections of the bit 12 and the rotation of the tool. When actuated and dropping angle, the electronics control module in the tool will spatially time the reciprocating bit motion so that the maximum deflection of the bit 12 occurs in the direction of the gravity vector so that the bit 12 will preferentially remove more formation from the low side of the hole than from the top side of the hole. The label "3A" corresponds the case in FIG. 3A where the bit 12 deflection is "negative" or away from the scribe line 7. Since the scribe line 7 is UP with a GTF of 0°, the bit 12 is displaced in the "DOWN" direction. The label "3C" corresponds to the case in FIG. 3C where the bit 12 deflection is "positive" or towards the scribe line 7. Since the scribe line 7 is DOWN with a GTF of 180°, the bit 12 is again displaced in the "DOWN" direction. Since the repetitive motion of the bit deflection is at the same frequency as the rotation of the RSDT, to an observer fixed with respect to earth, the bit displacement motion will appear to be at twice the frequency of the rotation rate of the RSDT. For every 180° of RSDT rotation, the bit will complete a full cycle of motion from centered (3B) to fully displaced in the direction of steering (3C) and back to centered (3D). For the next half-rotation of the RSDT, the motion will be from centered (3D) to fully displaced in the direction of the steering (3A) and back to centered (3B). In practice, the maximum displacement of the bit 12 is typically a few tenths of an inch, but could be more or less by design depending on the desired build rate specification.

Figure 7D:
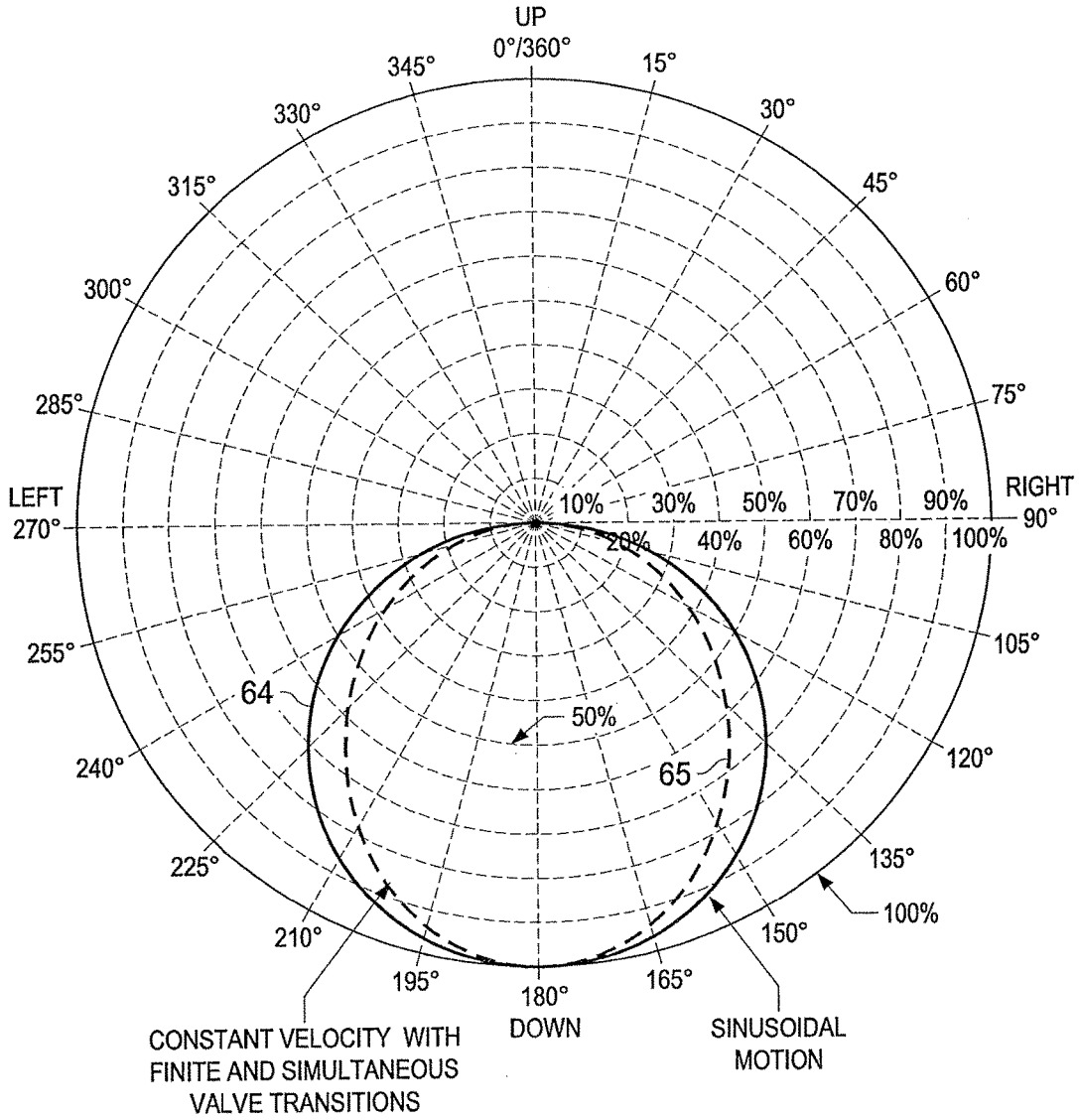

FIG. 7D is a polar plot of the bit 12 resultant displacement during steering operations. Curve 64 is a reference plot of the bit 12 instantaneous displacement for an ideal sinusoidal "simple harmonic" motion versus the RSDT rotations as a function of the GTF of the scribe line 7. Curve 65 is a plot of the bit 12 actual instantaneous displacement versus the RSDT rotations as a function of the GTF of the scribe line 7, using the "bang-bang" control algorithm and apparatus disclosed in FIGS. 7A and 7B. Using complementary control signals for the control of the valves 94 and 90, yields hydraulic flow rates to the lever arm actuating piston assembly 95 that are trapezoidal, and hence the velocity profile of the bit 12 displacement is also trapezoidal, because the velocity of the bit displacement is linearly proportional to the net flow rate into and out of the lever arm 87 actuating piston assembly 95. The plot of actual bit displacements shown in curve 65 is very similar to the plot of idealized bit displacements shown in curve 64. The bit 12 trajectory shown in curve 65 is actually preferable to the trajectory shown in curve 64 since the actual widening of the bore hole in the curved section with the trapezoidal motion control is somewhat less than the widening that would occur with sinusoidal motion control. If the maximum deflections of the bit are on the order of 0.25 inches while the tool is steering, then the diameter of the hole in the curved section will be asymmetrically enlarged by 0.25 inches in the direction of the curve; and the sides of the borehole (left and right) will be symmetrically enlarged by approximately 0.2 inches, reducing the frictional forces on the BHA and drill string as it rotates or slides through the curved section of the hole.

Figure 8A:
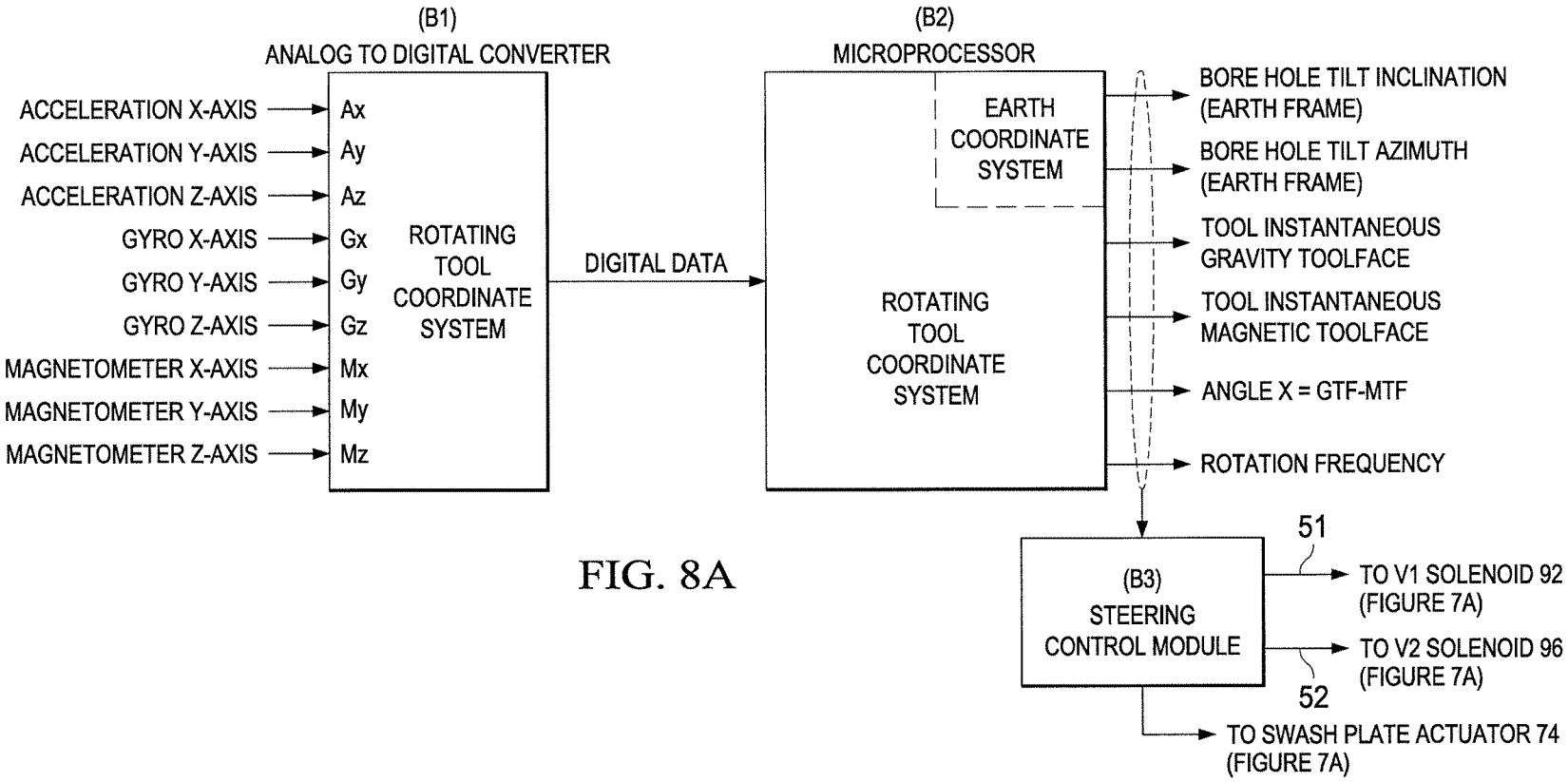
FIGS. 8A-8D illustrate an embodiment of the navigation module for the virtual geostationary platform.

FIG. 8A shows a block diagram of the optional dynamic non-inertial navigational sensors and processing. All navigational elements, including sensors and acquisition and processing electronics, are mounted directly to the collar or to a mechanical structure that is fixedly mounted to the collar and rotates with collar. In this embodiment, there exists no structure in the tool that counter rotates relative to the rotation of the RSDT to create a geostationary platform or near-geostationary platform. By not using a counter rotating assembly, the bias unit mechanics and wiring are simplified by eliminating the need for slip rings and rotating pressure compensated mud seals. Another advantage from a computational point of view is that there is a common coordinate system, a common rotation rate, and a common instantaneous GTF and MTF for the entire tool and all the sensors. Further, the absence of a physical geostationary assembly allows the sensors to be located within a few feet of the bit face and directly behind the hinge.

The term "geostationary platform" or "geostationary assembly" refers to an assembly in a rotating tool that counter rotates with respect to the rotating tool so that the assembly does not rotate with respect to a coordinate system that is fixed with respect to the earth as the rest of the tool rotates. The orientation of such a physical geostationary assembly, defined in terms of a non-rotating GTF and/or MTF, is controlled to effect the steering direction of the tool in a particular direction. The accelerometers and magnetometers used to control the orientation of the intended geostationary assembly can be mounted either on the geostationary assembly directly or on the rotating collar as was done in U.S. Pat. No. 6,742,604 to Brazil (hereinafter referred to as "Brazil"). In Brazil, the instantaneous position of the collar relative to the geostationary assembly is measured with an additional electromechanical component known as a resolver that would instantaneously read the relative position of the internal geostationary assembly with respect to the external rotating collar. The electromechanical resolver angle is used to translate only the GTF from the rotating collar frame of reference into the non-rotating frame of reference of the geostationary assembly. A much simpler approach shown in FIG. 8A creates a "virtual geostationary platform" by simultaneously acquiring 3 axes for each of 3 types of sensors, namely, accelerometers, gyroscopes, and magnetometers, 9-axes in total, all sharing a common coordinate system fixed to and rotating with the RSDT. The measurements are acquired in block B1. They are sent to block B2 where the conditioning algorithm shown in FIGS. 8B and 8C removes errors due to DC offsets and mounting misalignment, as well as errors from shock and vibration on the accelerometers. The virtual geostationary processing algorithm in block B2 label "EARTH COORDINATE SYSTEM" can be used to calculate the inclination and azimuth of the RSDT axis of rotation. By definition, the inclination and azimuth of the RSDT axis of rotation is the same as the bore hole inclination and azimuth. A rotation matrix driven by either instantaneous GTF or instantaneous MTF plus Angle X or the rotation rate of the tool from the z-axis gyro is used to convert the accelerometer and magnetometer measurements acquired in the RSDT rotating frame of reference to a virtual geostationary frame of reference (i.e., the "EARTH COORDINATE SYSTEM") to calculate the inclination and azimuth of the RSDT axis of rotation. The instantaneous GTF and MTF of the scribe line 7 on the rotating collar 43, and the angle between them, defined as "angle X," together with the virtual geostationary outputs of inclination and azimuth are used to navigate the RSDT and steer the well in the direction requested by the customer.

The geostationary frame of reference will have a z-axis pointing down hole and collinear with the borehole axis and substantially parallel to the z-axis of the RSDT. The x-axis of the geostationary frame of reference points up perpendicular to the z-axis of the borehole. The x-axis and z-axis and gravity vector are coplanar. The y-axis of the geostationary frame of reference is horizontal and points to the right when looking down hole, it is orthogonal to the x-axis, the z-axis, and the gravity vector. By definition, the inclination of the borehole is expressed as a positive number of degrees equal to the angle between the gravity vector and z-axis of the borehole and can range from 0° to 180°. The value of inclination in a vertical well is zero degrees and the inclination of a horizontal well is 90°. By definition, the azimuth of the borehole is expressed as a positive number of degrees between 0° to 360° equal to the angle between the projection of the z-axis onto the horizontal plane and the direction of magnetic North. The computation of azimuth is well known to anyone of ordinary skill in the art. To instantaneously convert a pair of transverse measurements, either acceleration due to gravity, or the earth's magnetic field, from the rotating non-inertial RSDT coordinate frame of reference to the local non-rotating inertial frame of reference, $Ax_{BOREHOLE}=Ax_{RSDT}*\cos(GTF)+Ay_{RSDT}*\sin(GTF)$, and $Ay_{BOREHOLE}=Ax_{RSDT}*-\sin(GTF)+Ay_{RSDT}*\cos(GTF)$, where $Ax_{BOREHOLE}$ and $Ay_{BOREHOLE}$ are the transverse components of the earth's gravity in the bore hole frame of reference, $Ax_{RSDT}$ and $Ay_{RSDT}$ are the transverse components of gravity in the RSDT frame of reference, and GTF is the instantaneous gravity tool face of the RSDT. As a quality check, the value of $Ay_{BOREHOLE}$ should be identically zero; if $Ay_{BOREHOLE}$ is not zero, then the computation of borehole inclination will not be valid. If a valid GTF is not available, then (MTF+Angle X) can be used as an estimate of the value of GTF. If both a valid GTF and a valid MTF are momentarily unavailable, then it may be possible to derive an estimated value of GTF from integrating the rotational velocity of the RSDT from the z-axis gyro sensor, Gz. The calculation of the borehole inclination is then $INCL=-ARCTAN(Ax_{BOREHOLE}/Az_{RSDT})$. $Mx_{RSDT}$, $My_{RSDT}$, $Mz_{RSDT}$, $Mx_{BOREHOLE}$, and $My_{YBOREHOLE}$, can be substituted for $Ax_{RSDT}$, $Ay_{RSDT}$, $Az_{RSDT}$, $Ax_{BOREHOLE}$, $Ay_{BOREHOLE}$ respectively in the rotation matrix for the calculation of the earth's magnetic field in the borehole frame of reference and the standard calculation of borehole azimuth.

One advantage of a rotating navigational platform is that the devices are continuously auto-calibrating by using the rotation of the system to cancel mounting and DC device errors that may be a function of temperature. This allows the accurate measurement of very small values of tilt inclination when the borehole is near vertical and tilt azimuth when the bore hole is oriented N-S or S-N and the tool axis is oriented parallel to the earth's magnetic field lines. Contrary to Brazil, an embodiment in this disclosure translates the measurements from the RSDT rotating frame of reference into bore hole tilt inclination and bore hole tilt azimuth in the earth's stationary frame of reference, without the need to pause drilling or to create a geostationary assembly in the tool. The virtual geostationary platform of the RSDT is able to continuously and dynamically measure bore hole inclination (tilt inclination) and bore hole azimuth (tilt azimuth) with respect to the non-rotating earth's coordinate system.

Figure 8B:
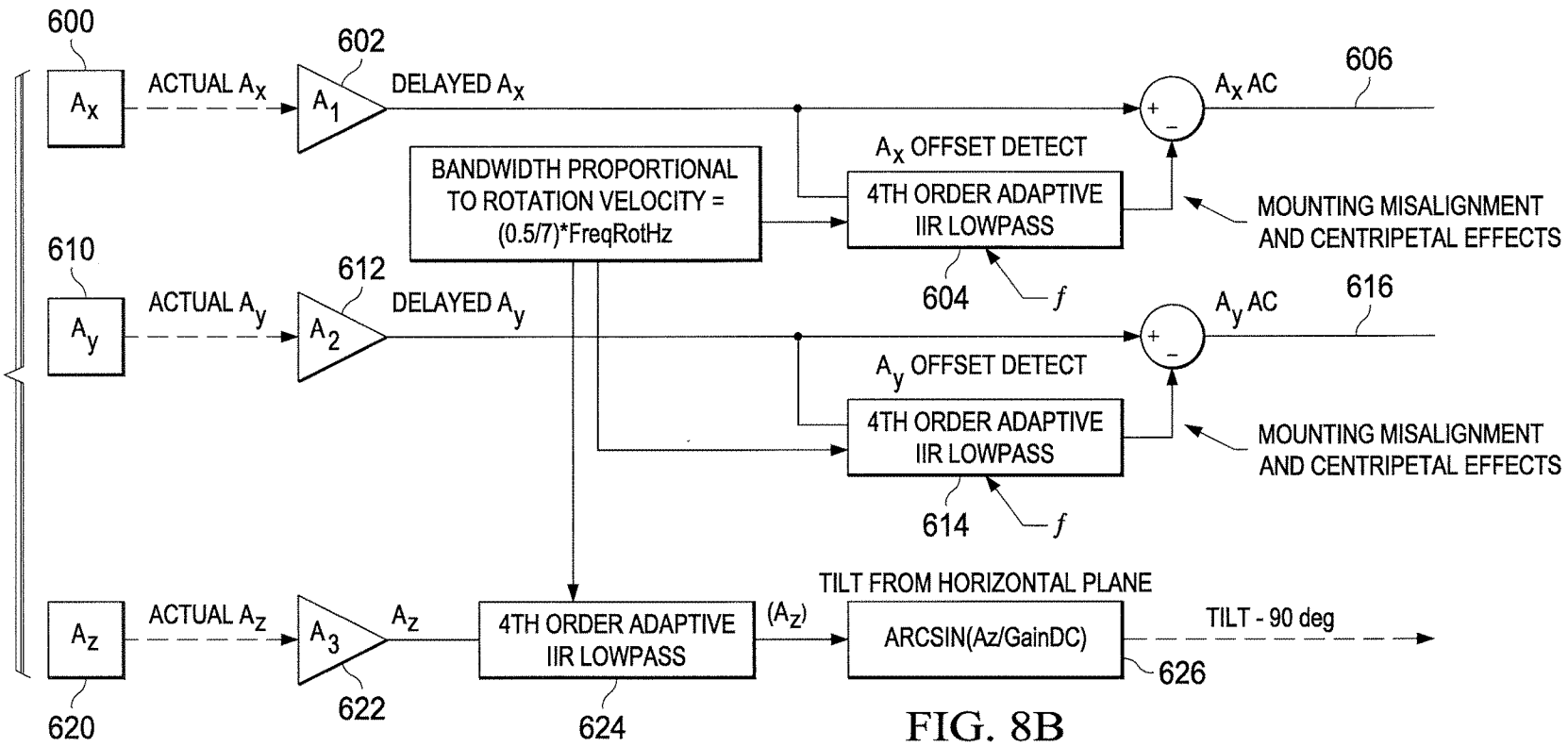

FIG. 8B shows a block diagram of an embodiment of the processing algorithm that is used to cancel the misalignment errors on the transverse accelerometers. This discussions is also applicable to magnetometers. Three accelerometers, 600, 610, 620, are shown for Ax, Ay, and Az, respectively. The x- and y-axes represent the transverse axes, the z-axis is the centerline of the tool and is positive in the down hole direction. The output of the accelerometers is a serial digital data stream; there are no analog signals represented in the schematic. The processing for Az, 620, is straightforward since it always reads a DC value of gravity, other than for axial shocks and misalignment errors which can easily be filtered out by the filter 624, even at low rates of rotation. Accelerometers should preferably be mounted as close to the RSDT axis of rotation as possible to minimize the effects of stick-slip rotation which adds an AC component to the otherwise DC value of centripetal acceleration. It is also beneficial for the Az accelerometer to be mounted as close to the centerline of rotation as possible to minimize any DC centripetal acceleration errors from the misalignment. For the Ax and Ay accelerometers, 600 and 610, the misalignment errors and the off-axis centripetal accelerations are DC signals. The filters 604 and 614 are identical digital $4^{th}$-order adaptive IIR low-pass filters. The cutoff frequency is a function of the tool rotational frequency. If the frequency of rotation is 7 Hz (420 rpm), then the low pass cutoff frequency is 0.5 Hz. If the frequency of rotation is 3 Hz (180 rpm), then the low pass cutoff frequency is 0.214 Hz. The filter gain is down by roughly 90 dB with 360° of phase shift at the rotation rate of the tool, so the output of each filter 604 and 614 is only the DC error signals for Ax and Ay respectively, which are then subtracted from their respective channels, yielding error free signals 606 and 616. This allows Ax and Ay to be used to detect very small amounts of tilt when drilling vertically. This same error correction processing is also used for the magnetometers. The filter 624 for Az (and Mz) is identical to the filters 604 and 614 for the transverse measurements Ax and Ay. Because DC errors such as electrical offsets cannot be cancelled by this method, the devices for the axial measurements must be calibrated over temperature.

Figure 8C:
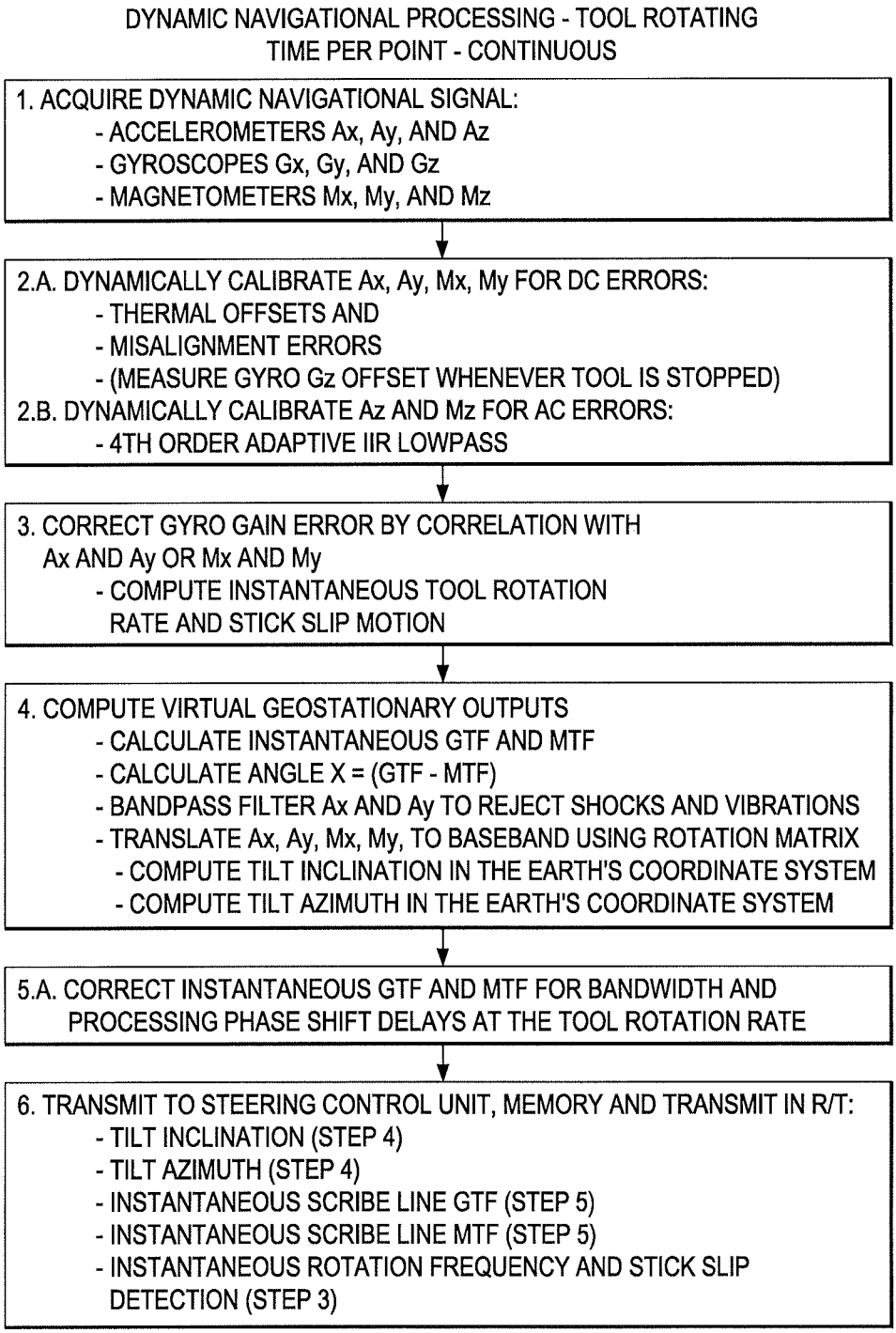

FIG. 8C shows a flow diagram of the dynamic navigational processing that can be used to steer the tool while it is rotating. This processing is running continuously as the tool is rotating. The axial values of Az and Mz do not change rapidly and can be updated every few seconds in step 2.*b*. The transverse measurements are continuously updating in step 2.*a*. In step 3, the gyroscope offsets for all three axes are updated when the tool is stationary in the hole. The z-axis gyroscope gain error is calibrated down hole by correlation with either Mx and My or Ax and Ay in the event of magnetic interference. In step 4, the instantaneous values of GTF and MTF and Angle X are calculated first since these are needed to dynamically drive the coefficients in the rotation matrix. Then the transverse accelerometer and magnetometer measurements are translated to the earth's coordinate system and combined with Az and Mz to compute bore hole inclination and bore hole azimuth. Angle X serves two purposes. One is that azimuthally sensitive measurements are typically acquired versus MTF. MTF plus angle X will give a pseudo GTF value so the azimuthally acquired measurements can be correctly oriented with respect to the top of the bore hole. In step 5, GTF and MTF are corrected for processing delays so that they read the spatially corrected values of GTF and MTF for steering purposes. The data is then transmitted with low latency to the steering control unit for the generation of steering commands, storage in tool memory, and combination with other data for R/T telemetry transmission to the surface.

Figure 8D:
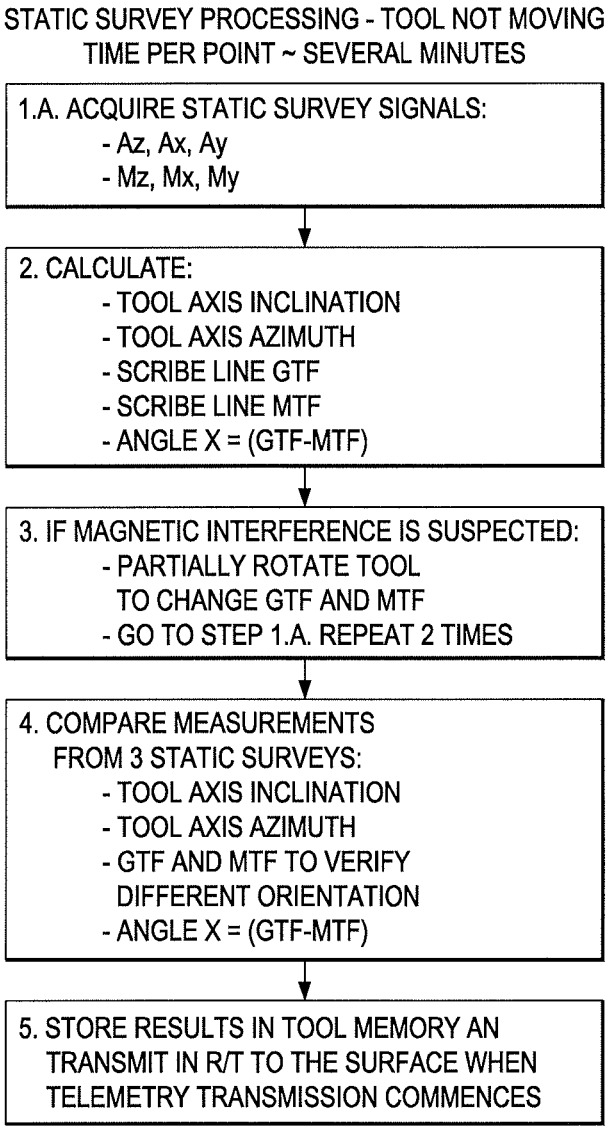
FIG. 8D (PRIOR ART)

FIG. 8D shows the static survey processing that can be used when the tool is not moving, typically at every connection while the drill string is in the slips. This processing takes several minutes to acquire and process the measurements. The tool must be stopped. The earth's gravity accelerations and earth's magnetic field are measured in all 3 tool axes. If magnetic interference or misalignment errors are suspected, the static measurements from two or more additional orientations of GTF and/or MTF can be combined to improve the accuracy of the bore hole inclination and azimuth.

Figure 9:
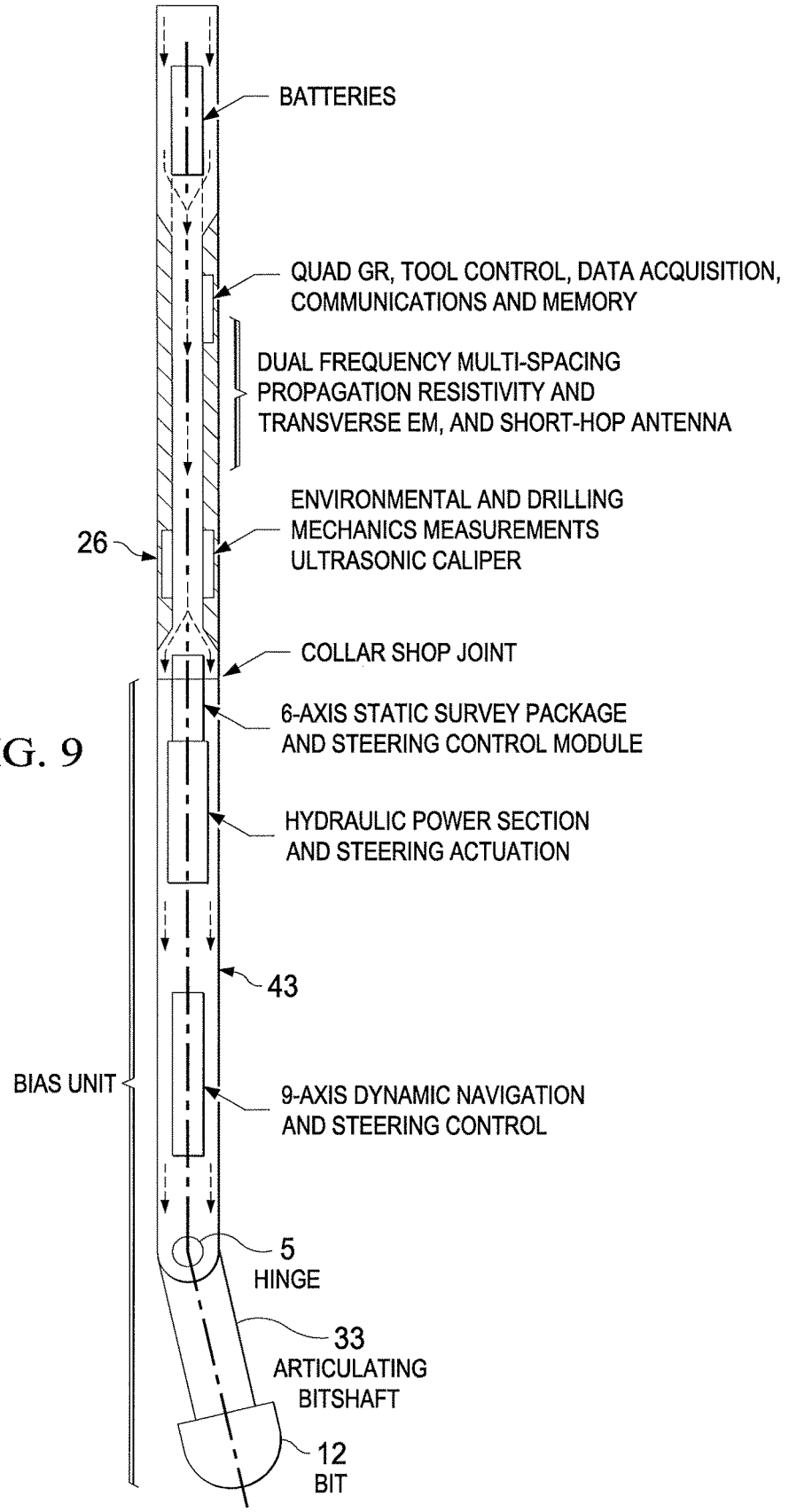
FIG. 9 illustrates a side perspective view of a deployed rotary steerable tool string having a bottom hole assembly ("BHA") configured with a virtual geostationary platform.

FIG. 9 shows an overall tool layout of one possible embodiment of the RSDT. At the bottom end of the tool, the bit 12 is attached to the bit shaft 33 which is attached to the drill collar 43 by means of the hinge 5. Stabilizers are not shown. The 9-axis dynamic navigation and steering control electronics and sensors that comprise the virtual geostationary platform are located in a housing just above (or behind) the hinge 5. The dynamically variable displacement axial piston pump is located in the "Hydraulic Power Section and Steering Actuation" block. The upper section of the tool includes auxiliary measurements including but not limited to a 6-axis static survey package, environmental and drilling mechanics measurements, ultrasonic caliper, multi-spacing propagation resistivity, transverse EM for distance to nearby resistivity contrasts, short hop telemetry antenna, quadrant natural GR, central data acquisition, communications, memory, and backup batteries for power during connections.

This disclosure has introduced and discussed several benefits and features unique to the dynamically variable displacement axial piston pump related to operation and implementation of the RSDT. However, it should be noted that those same benefits and features unique to the dynamically variable displacement axial piston pump are applicable to the design and operation of other down hole tools, whether conveyed by drill pipe, wire line, or coiled tubing.

When the power and/or total energy required to operate a downhole MWD or LWD tool for up to 200 hours exceeds the power that can be practically provided by down hole batteries suitable for oil field use, then it becomes practical to generate power down hole by means of a mud driven fluid turbine. In this case, the common practice is to provide a drilling mud driven fluid turbine, such as that described in Bradley U.S. Pat. No. 3,743,034, and Jones and Malone U.S. Pat. No. 5,249,161. The fluid turbine may provide power to drive either an electrical alternator or a hydraulic pump. The fluid turbine must operate over a range of mud flow rates and mud densities to be a practical source of down hole power.

The no-load rotational velocity of the turbine is proportional to flow rate and the stall torque is proportional to flow rate and mud weight. Since power is the product of torque times rotational velocity, the available power can increase roughly as the square of the mud flow rate times the increase in the mud weight. Further, it is common to cover a 2:1 flow rate range with a single turbine design, meaning that the available power can easily quadruple over that range. By way of illustration, if the minimum mud weight is taken to be 8.3 pounds per gallon, the maximum mud weight could be 16 pounds per gallon, another factor of two increase in the available torque. A well designed turbine should provide a minimum amount of power required to operate the system at the minimum flow rate and minimum drilling mud weight. For the purposes of this discussion, the minimum power required to operate a given system can be chosen to be 2 HP. This means that the available power from the turbine at the maximum flow rate and mud weight can be roughly 8 times the power available at the minimum flow rate and mud weight, roughly 16 HP.

If the turbine is driving an electrical alternator, as described in "Jones and Malone" U.S. Pat. No. 5,249,161, the output current can be managed by the load, but the output voltage of the alternator will tend to double as the turbine rotational speed doubles. One method to handle this situation is to use a hybrid homo-polar alternator with field windings to boost or buck the output voltage and hold it within a manageable range over all or part of the mud flow range. There will be various design tradeoffs to minimize the copper $I^2R$ losses in the windings of the alternator in order to minimize the temperature increase while keeping the output voltage below a manageable level. In addition, there are copper $I^2R$ losses in the field windings as well. The field windings will never be able to practically cancel the internal magnetic field, so there will be a rotational velocity above which the voltage will unavoidably increase even with the maximum field bucking current. Additionally, due to volumetric and efficiency limitations, there is a practical upper limit to the amount of power that can be reliably generated by an electrical alternator. For those applications requiring more than about 3 HP, it could be more practical to drive a hydraulic pump with a fluid turbine instead of an electrical alternator.

An embodiment of the present disclosure uses a hydraulic pump driven by the mud powered fluid turbine. If the turbine is driving a fixed positive displacement pump as discussed in "Bradley" (U.S. Pat. No. 3,743,034), as the turbine speed increases, the output flow rate of the pump will increase. Further, as the flow rate increases, the pressure will increase to the point limited by a pressure relief valve. At the maximum drilling mud flow rate and weight, generating roughly 16 HP, the turbine will prematurely wear out from erosion effects and the relief valve on the output of the pump will dissipate 5 to 10 HP as the hydraulic fluid is adiabatically vented through an orifice back to the low pressure hydraulic reservoir causing the temperature of the valve to increase well beyond specified levels resulting in valve and system failure.

One solution to this problem is to replace a fixed positive displacement pump with a dynamically variable displacement axial piston pump, also referred to as a "swash plate pump." The dynamically variable displacement axial piston pump is ideally suited to be used in an embodiment of the present disclosure. Outside the field of subterranean oil well down hole drilling tools, dynamically variable displacement axial piston pumps are used in many places such as hydraulically operated tractor implements, construction equipment such as bull dozers, and very commonly in zero-radius-turn grass cutting machines. In these cases, one or more reversible dynamically variable displacement axial piston pumps are used to control the variable output flow rate and flow direction to independently drive wheels and/or shafts. In the field of drilling mud powered down hole MWD and LWD tools, the pump provides an effective power management solution for mud driven drill collar mounted tools for use in drilling oil and gas wells, although such an implementation has not previously been implemented. As the flow rate and mud weight increases, the swash plate angle can be decreased, reducing the displacement of the pump, which allows the flow rate out of the pump to remain constant. For a given drilling mud flow rate and weight, the swash plate angle will be selected to provide the amount of flow and pressure required by the load being driven by the dynamically variable displacement axial piston pump. The swash plate angle can be controlled by either an electrically powered linear actuator or by an "electronic displacement controller," which uses a proportional valve and hydraulic pistons to actuate the swash plate.

FIG. 7A, as previously described above, shows an open loop hydraulic embodiment where the dynamically variable displacement axial piston pump 70 is used to regulate both the variable input power available from the turbine 71 and match it to the variable output power demanded by the dynamic load, comprised of valves 90 and 94 and bidirectional piston actuator 95. In this embodiment, the setting of the swash plate angle is determined by drilling mud flow rate and the amount of hydraulic fluid demanded by the load. As previously discussed in detail, the swash plate angle is adjusted to increase or decrease the amplitude of the motion of the lever arm 87 that controls the coherent symmetrical deflections of the bit.

Figure 10:
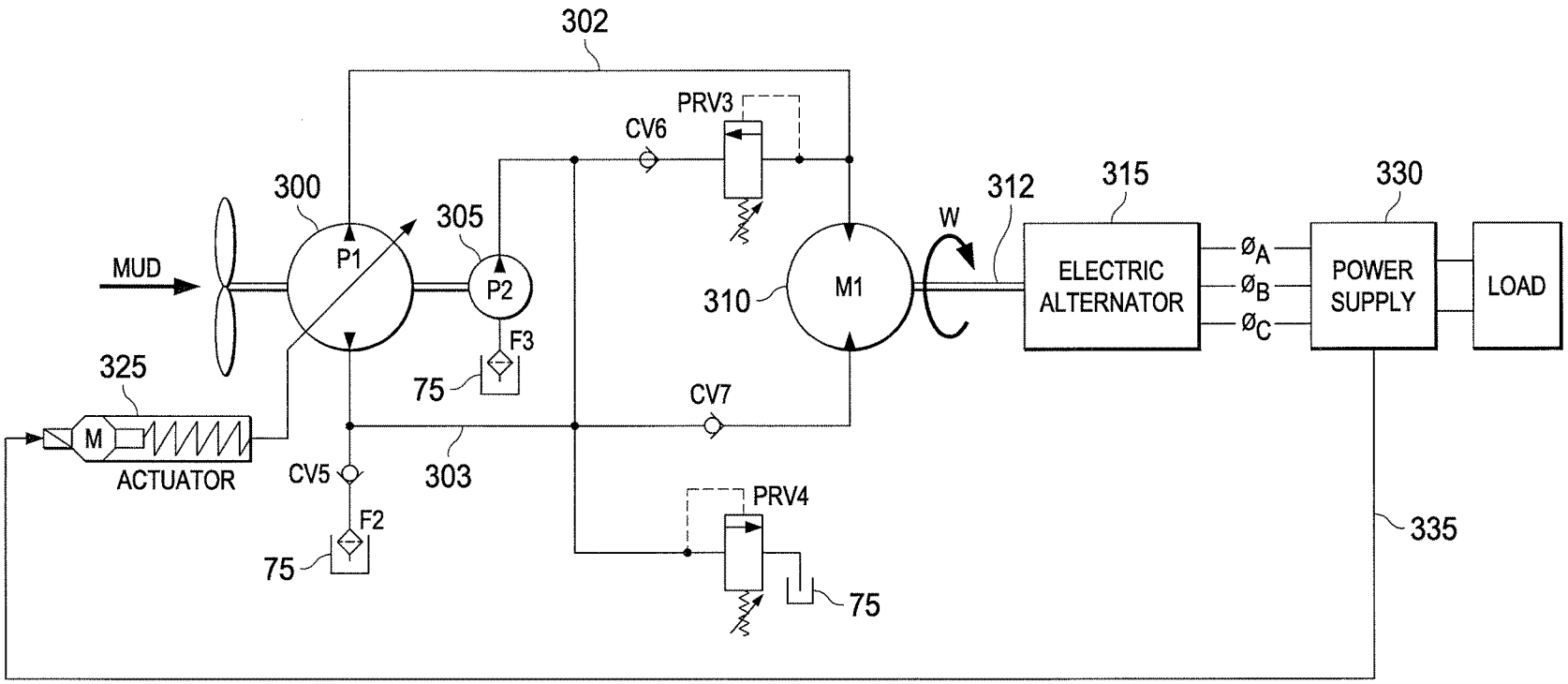
FIG. 10 illustrates another application for the drilling of oil and gas wells and shows an embodiment where an output of a dynamically variable displacement axial piston pump can be connected by a hydraulic line to a hydraulic motor, thereby forming a hydraulic transmission.

FIG. 10 shows another application for the drilling of oil and gas wells, where the output of the dynamically variable displacement axial piston pump 300 can be connected by a hydraulic line 302 to a hydraulic motor 310, forming a hydraulic transmission. In this embodiment, the swash plate angle is adjusted by means of an actuator 325, which can be either motor driven or hydraulically driven, to control the output shaft speed of the hydraulic motor 310. The hydraulic motor 310 can be a fixed displacement hydraulic motor or a variable displacement hydraulic motor to allow more degrees of freedom for control. The output shaft 312 of the hydraulic motor 310 can drive an electrical alternator 315. Since the transmission comprised of the dynamically variable displacement axial piston pump 300 and hydraulic motor 310 can maintain a constant speed of the output shaft 312 over a wide range of mud flow rates and weights, the generator can be a very simple and basic brushless alternator. The output voltage of ΦA, ΦB, and ΦC, would be held constant by maintaining a constant speed of the input shaft 312 of the motor 310 by the adjustment of the swash plate angle depending on the drilling mud flow rate. The power supply 330 would measure the output voltage of the alternator 315 and generate a feedback signal 335 to increase or decrease the angle of the swash plate by means of actuator 325. A charge pump 305 ensures that the dynamically variable displacement axial piston pump 300 is primed at start up. The hydraulic fluid reservoir is 75. Various relief valves, PRV3 and PRV4 are provided to prevent any overpressure conditions. Various check valves, CVS, CV6, and CV7 are provided to prevent any unwanted back flow. Filters F2 and F3 are provided to ensure that any particulate impurities in the hydraulic fluid remain in the fluid reservoir and are not re-circulated through the system. The swash plate angle of the dynamically variable displacement axial piston pump 300 regulates the input power available from the drilling mud driven turbine as well as providing the variable power that may be demanded by the load for drill pipe conveyed measurements or services.

Figure 11A:
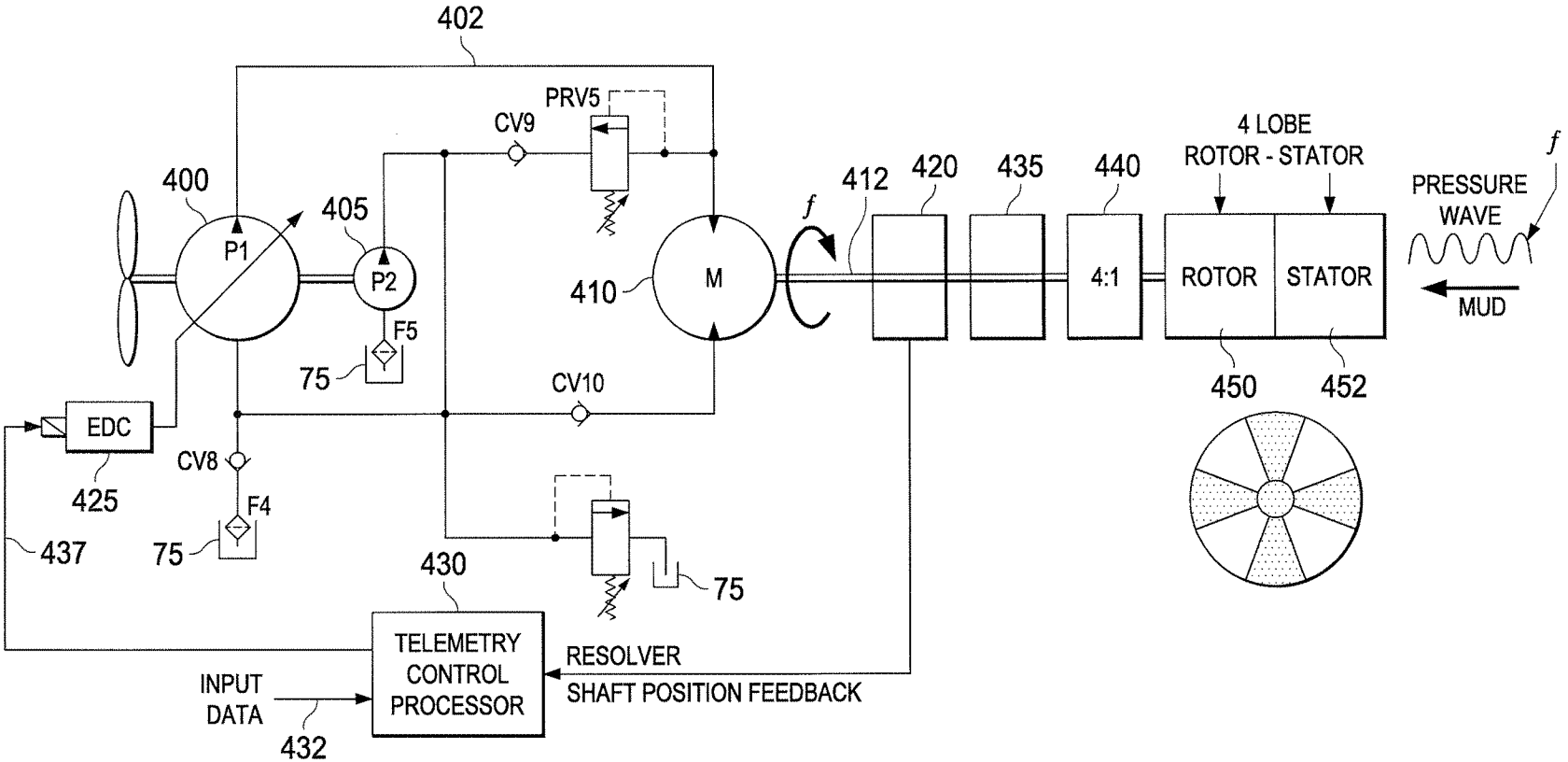
FIGS. 11A-11B illustrate yet another application embodiment where an output shaft of a hydraulic motor can be configured to drive a rotary mud valve for the generation of mud pulse telemetry.

FIG. 11A shows yet another embodiment where the output shaft 412 of the hydraulic motor 410 could be used to drive a rotary mud valve rotor 450 for the generation of a drill pipe conveyed mud pulse telemetry while drilling. As the rotary mud valve rotor 450 is rotated next to the rotary mud valve stator 452, it generates an oscillating sequence of high and low pressures, as described in Jones and Malone. Phase shifts are periodically introduced into the rotation of the rotary valve rotor 450 in order to digitally encode data into a sequence of high and low pressures. The dynamically variable displacement axial piston pump 400 and hydraulic motor 410 would replace the electrical motor that is driving a rotary valve as described in Jones and Malone. The output of the hydraulic motor shaft 412 would be connected to a shaft resolver 420 and a 2-pole 1-position magnetic positioner 435. The gear box 440 could be any gear ratio that is advantageous for the operation of the hydraulic motor 410, but would need to match the number of lobes on rotary mud valve rotor 450 and stator 452. The telemetry control processor 430 receives an input data stream 432, and use the shaft position feedback from the resolver 420 to actuate the swash plate by means of actuator control line 437 and swash plate actuator 425 to introduce phases shifts into the mud pressure wave generated by rotary valve rotor 450 and stator 452.

Figure 11B:
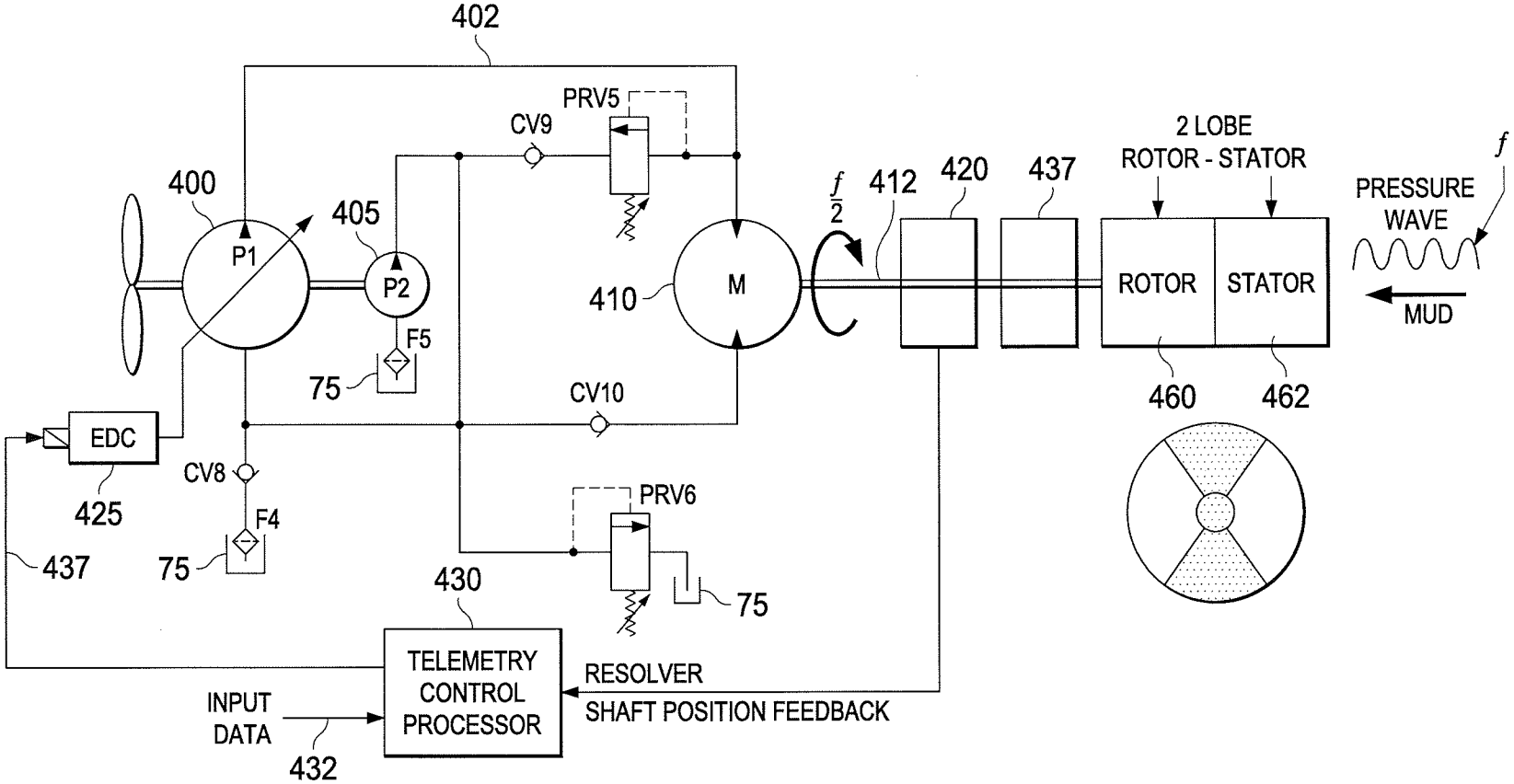

An alternative embodiment of a hydraulically driven mud pulse telemetry system is shown in FIG. 11B, which is similar to the embodiment shown in FIG. 11A, but with a 2-lobe rotary valve rotor 460 and stator 462, without a gear box, but using a 4-pole (2 position) magnetic positioner 437 and resolver 420. The resolver 420 is needed on the output of the hydraulic shaft in order to know and control rotation of the hydraulic motor shaft 412 as a function of time. The magnetic positioner 437 is an optional but preferred mechanism because it will passively return the rotary valve rotor 460 to an open position when the power is OFF or in the event of an electronics failure to prevent pulling wet pipe. A processor 430 attached to the swash plate actuator 425 control will accept an incoming bit stream 432 via a digital data bus. It will convert the incoming digital data stream 432 into a sequence of shaft positions 412 as a function of time. The bits may be encoded into pressure pulses using BPSK or QPSK or Feher QPSK. The resolver 420 feeds back the shaft 412 position to the processor 430 that is controlling the rotary valve 460 data stream so that the processor 430 may make dynamic adjustments to the swash plate angle by means of control line 437 and swash plate actuator 425, to achieve the desired pressure wave sequence of mud pressures for a drill pipe conveyed mud pulse telemetry while drilling.

Figure 12:
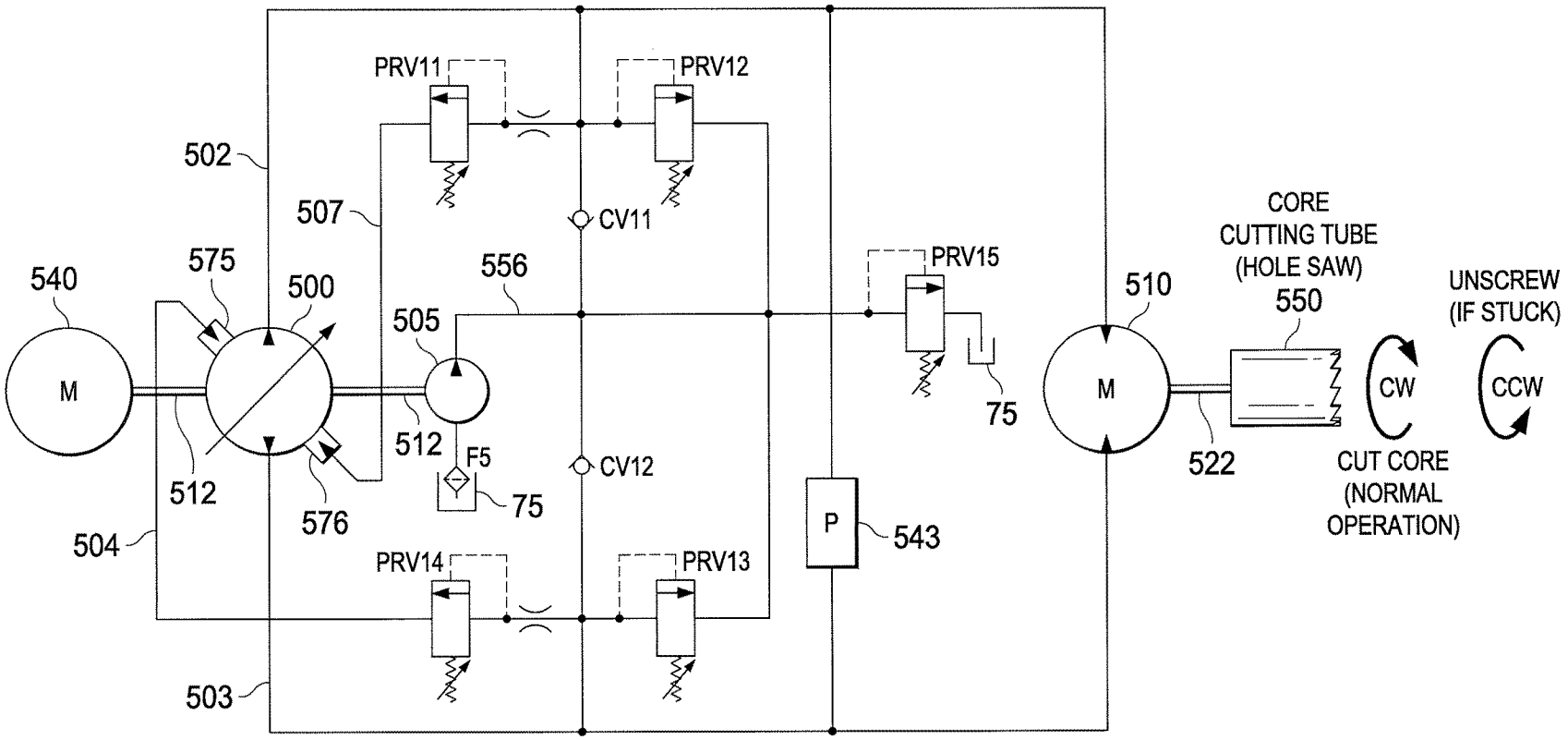
FIG. 12 illustrates an application of the dynamically variable displacement axial piston pump in a closed loop reversible hydraulic system for the cutting of sidewall cores.
Figure 14:
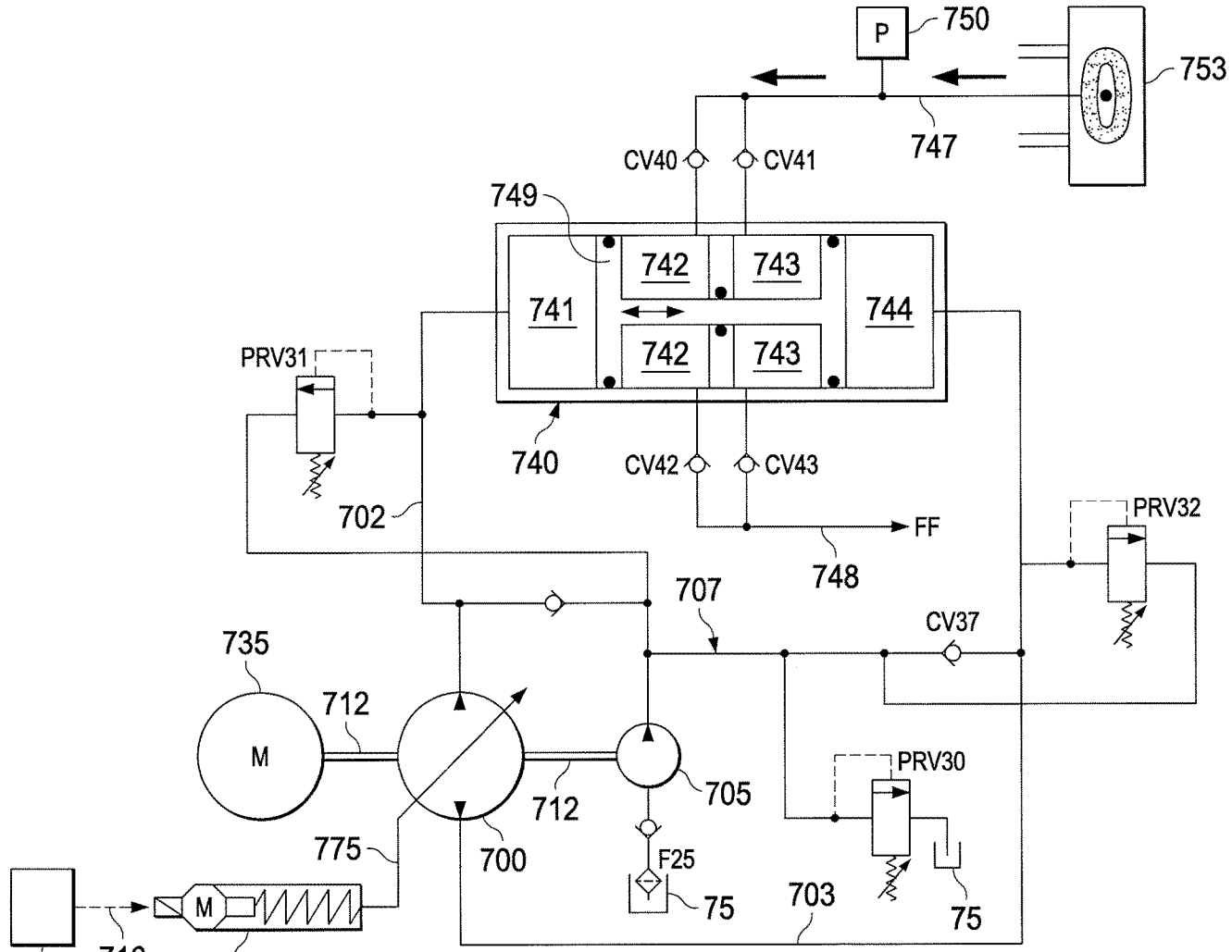
FIG. 14 show an embodiment using a dynamically variable displacement axial piston pump in a closed loop configuration to control and drive a dog-bone pump.

The previously disclosed applications and embodiments for the dynamically variable displacement axial piston pump have all been open loop hydraulic circuits that do not take full advantage of reversibility of the dynamically variable displacement axial piston pump. The dynamically variable displacement axial piston pump can also be used in closed loop hydraulic applications where the ability of the pump to reverse the flow of hydraulic fluid through the pump can result in significant reduction in the number of valves to be controlled, a reduction in the number of hydraulic passageways, as well as more precise control of low pressure differential applications such as formation fluid sampling. FIGS. 12 and 14 will illustrate the benefits of using the variable displacement axial piston dynamically variable displacement axial piston pump in closed loop fully reversible hydraulic circuits. These embodiments can be incorporated into down hole tools that are conveyed on wire line, coiled tubing, and/or drill collar.

FIG. 12 is the hydraulic schematic for a sidewall coring application. Hydraulic pumps have been used in this type of application before, but the pumps are fixed displacement and unidirectional. If the core cutting hole saw gets stuck, the motor driving the saw cannot be reversed and the shaft must be sheared off so that the tool can be safely extracted from the hole without damaging either the bore hole or the tool. The schematic shown in FIG. 12 solves this problem. An electric motor 540 drives a shaft 512 that drives a dynamically variable displacement axial piston pump 500 and a charge pump 505. The swash plate angle of the dynamically variable displacement axial piston pump 500 is increased by a swash plate actuator (not shown) so that high pressure hydraulic fluid flows out of line 502 to hydraulic motor 510, causing the shaft 522 to rotate the core cutting hole saw 550 in the direction of cutting. The pressure across the hydraulic motor 510 can be monitored to confirm system operation and identify possible anomalous conditions. If the cutter 550 gets stuck, the high pressure in line 502 will increase so that it triggers the pressure relief valve PRV11 and drive fluid through line 507 connected to the negative servo piston 576 reducing the angle of the swash plate in pump 500. If it is determined by the operator that the cutter 550 is stuck, the direction of rotation of the motor 510 shaft 522 can be reversed, unscrewing the cutter, by setting the swash plate angle to a negative value, causing high pressure to flow in line 503. Over pressure relief is provided by PRV14. In that case, high pressure would be applied to the swash plate positive servo valve 575 causing the swash plate angle to reduce the flow rate of the dynamically variable displacement axial piston pump 500 relieving the over pressure condition in line 503. The advantage of this system is that it automatically protects itself, and if the cutter 550 gets stuck, the pump can be reversed, unscrewing the cutter 550 from the shaft 522 so that the shaft 522 can be safely retracted and the tool can be pulled out of the hole.

Figure 13:
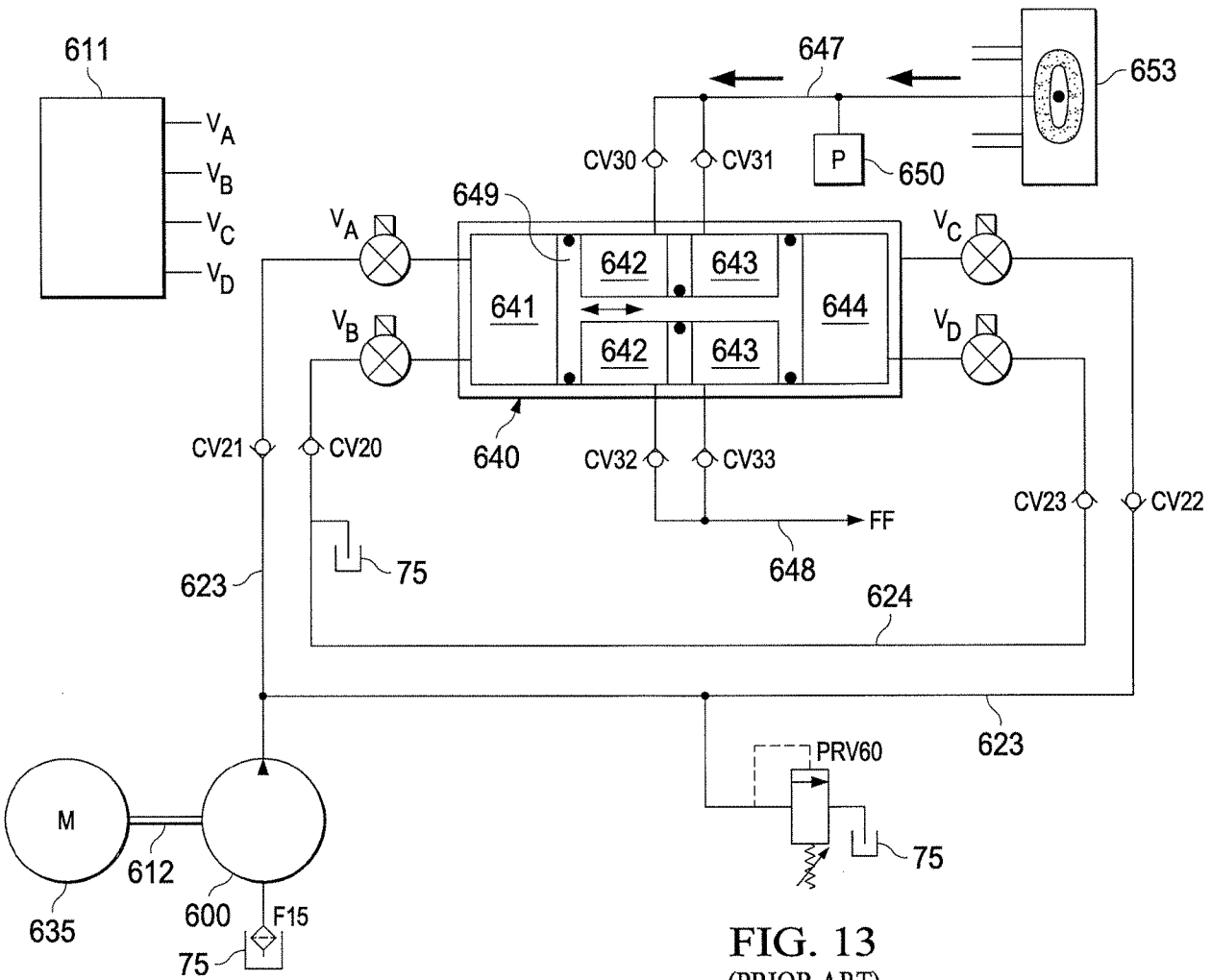
FIG. 13 (PRIOR ART)
FIG. 13 shows the prior art used to drive a dog-bone pump for the sampling formation fluid.

Another application for which the variable displacement axial piston pump is ideally suited is that of formation fluid sampling using a "dog-bone piston pump." An example of the prior art is shown in FIG. 13. Using a fixed displacement single ended pump 600 requires 4 valves $V_A$, $V_B$, $V_C$, and $V_D$, and 4 check valves CV20, CV21, CV22, and CV23 to drive the dog-bone piston pump 640. The side-wall packer probe 653 is deployed up against the bore hole wall with enough force to make a hydraulic seal with the formation. To drive the dog-bone piston pump 640 piston 649 to "the right," in the figure, the electric motor 635 drives the non-reversible fixed displacement pump 600. The valves VA and VD are actuated or "open" while the valves VB and VC are off or "closed." The high pressure fluid in line 623 flows through check valve CV21 through valve VA into chamber 641 displacing the piston 649 to the right. Low pressure fluid flows out of chamber 644 through valve VD to the tank 75. Fluid is extracted from the formation through flow line 647, and is sucked into chamber 643. At the same time, formation fluid in chamber 642 is push out through check valve VC32 into the flow line 648, where the fluid will either be discharged into the bore hole or diverted to sample bottle for transport to the surface when the tool is pulled out of hole. Once the dog-bone piston pump 640 piston 649 has fully moved to the right, the valves are reversed. VA and VD are closed while valves VB and VC are opened, allowing high pressure fluid from the pump 600 to flow into chamber 644 displacing the dog-bone piston 649 to the left in the figure. The formation fluid that has just been pulled into the chamber 643 is now squeezed out through check valve CV33 into the line 648 for discharge into the bore hole or to further fill a sample bottle for transport to the surface. The valves VA, VA, VC, and VD are all controlled by means of a control unit 611. Any over pressure condition that occurs is relieved by pressure relief valve PRV60. Controlling the rate of formation fluid sampling is accomplished by controlling the speed of the electric motor 635 in response to changes in pressure measured by the pressure transducer 650.

The embodiment in FIG. 14 is the result of replacing the "prior art" fixed displacement pump 600 in FIG. 13 with a dynamically variable displacement axial piston pump 700 shown in FIG. 14. The valves VA, VB, VC, and VD and the check valves CV20, CV21, CV22, and CV23 in FIG. 13 can be removed, and the number of hydraulic passageways is reduced, greatly simplifying the hydraulic manifold. A further simplification is that the electric motor 735 that drives the variable displacement axial piston pump 700 and charge pump 705 through the drive shaft 712 can be a fixed speed induction motor. With the side-wall packer probe 753 deployed up against the bore hole wall so that it makes a hydraulic seal with the formation, the swash plate angle of the dynamically variable displacement axial piston pump 700 is increased in the positive direction by the swash plate actuator 725 so that hydraulic fluid flows through line 702 into chamber 741 and out of chamber 744 of the dog-bone piston pump 740 through line 703, causing the dog-bone piston 749 to displace to the right. This forces formation fluid out of chamber 742 through check valve CV42 into line 748 for discharge into the bore hole or diversion into a sample bottle for transport to the surface when the tool is pulled out of hole. At the same time, formation fluid from the probe 753 is pulled into chamber 743 through flow line 747 and check valve CV41. The setting of the swash plate angle can be increased or decreased in response to readings from the flow line pressure transducer 750 to ensure that pressure drop in the flow line 747 is not too low, which would cause any dissolved gas in the formation fluid in line 747 to come out of solution. Once the dog bone piston 749 has reached its maximum travel to the right, the swash plate angle of the dynamically variable displacement axial piston pump 700 is reversed by means of the swash plate actuator 725 under the control of control module 711 and control lines 716. When the swash plate angle is negative, the flow through the dynamically variable displacement axial piston pump 700 is reversed. High pressure hydraulic fluid flows in line 703 into chamber 744 and out of chamber 741 through line 702 back to the pump. This causes the dog-bone piston 749 to displace to the left in the figure, forcing the formation fluid in chamber 743 to flow through check valve CV43 into flow line 748 for discharge into the borehole or continued diversion into a sample bottle (not shown) for transport to the surface when the tool is pulled out of hole. At the same time formation fluid is being pulled into chamber 742 through check valve CV40, flow line 747, and probe 753. Over pressure relief for the pump 700 is provided by the pressure relief valves PRV31 and PRV32. Using a reversible closed loop variable displacement axial piston pump results in a significant simplification of the hydraulic manifold required to interface with the dog-bone pump and results in a greater degree of formation fluid pressure control.

What is claimed is:

1. A bottom hole assembly comprising:

a drill collar, and a power source, comprising:

a dynamically adjustable swash plate, a dynamically variable displacement axial piston pump, a drilling mud powered fluid turbine that drives an input shaft of the dynamically variable displacement axial piston pump; and a microcontroller assembly comprising:

a processor, a nonvolatile memory element, a program stored in the nonvolatile memory configured to control the amplitude of the power source output by changing the angle of the dynamically adjustable swash plate of the dynamically variable displacement axial piston pump.

2. The bottom hole assembly of claim 1, wherein the power source further comprises an axial piston pump actuator configured to control the angle of the swash plate.

3. The bottom hole assembly of claim 1, wherein the power source further comprises a charge pump configured to provide minimum flow to the dynamically variable displacement axial piston pump.

4. The bottom hole assembly of claim 1, wherein the power source further comprises a low pressure input line configured with a check valve and a pathway to a hydraulic reservoir through the check valve to provide additional fluid to the dynamically variable displacement axial piston pump.

5. The bottom hole assembly of claim 1, wherein the dynamically variable displacement axial piston pump is configured in a hydraulic open loop circuit to regulate the variable power demanded by a load.

6. The bottom hole assembly of claim 1, wherein the dynamically variable displacement axial piston pump is configured in a hydraulic closed loop circuit to regulate the variable power demanded by a load.

7. The bottom hole assembly of claim 1, further comprising a mud flow rate sensor configured to be in communication with the microcontroller assembly such that substantially realtime mud flow rate data is provided to the microcontroller assembly.

8. The bottom hole assembly of claim 7, wherein the microcontroller assembly further comprises a program stored in the nonvolatile memory configured to perform the steps of:

receiving substantially realtime mud flow rate data from the mud flow rate sensor, controlling the amplitude of the power source output, and changing the angle of the dynamically adjustable swash plate of the dynamically variable displacement axial piston pump in relation to the substantially realtime mud flow rate data received from the mud flow rate sensor.

9. The bottom hole assembly of claim 1, further comprising a revolution rate sensor configured to be in communication with the microcontroller assembly such that substantially realtime revolution data for the bottom hole assembly is provided to the microcontroller assembly.

10. The bottom hole assembly of claim 9, further comprising:

a drill bit capable of axial deflection; and a drill bit deflection amplitude sensor configured to be in communication with the microcontroller assembly such that substantially realtime drill bit deflection amplitude data is provided to the microcontroller.

11. The bottom hole assembly of claim 10, wherein the microcontroller assembly further comprises a program stored in the nonvolatile memory configured to performs the steps of:

receiving substantially realtime revolution data from the revolution rate sensor, receiving substantially realtime drill bit deflection amplitude data from the drill bit deflection amplitude sensor, and controlling the amplitude of the power source output and changing the angle of the dynamically adjustable swash plate of the dynamically variable displacement axial piston pump in relation to one or both of the substantially realtime revolution rate data and the substantially realtime bit deflection amplitude data.

12. A method of directional drilling well bore sections, comprising the step of deploying a bottom hole assembly comprising:

a drill collar, and a power source, comprising:

a dynamically adjustable swash plate, a dynamically variable displacement axial piston pump, a drilling mud powered fluid turbine that drives an input shaft of the dynamically variable displacement axial piston pump; and a microcontroller assembly comprising:

a processor, a nonvolatile memory element, a program stored in the nonvolatile memory configured to control the amplitude of the power source output by changing the angle of the dynamically adjustable swash plate of the dynamically variable displacement axial piston pump.

13. The method of claim 12 further comprising the steps of:

using a dynamically variable displacement axial piston pump to provide power to a downhole tool configured on the bottom hole assembly, and driving an input shaft of the dynamically variable displacement axial piston pump with a drilling mud powered fluid turbine.

14. The method of claim 12, wherein the dynamically variable displacement axial piston pump is configured in a hydraulic open loop circuit to regulate the variable power demanded by a load.

15. The method of claim 12, wherein the dynamically variable displacement axial piston pump is configured in a hydraulic closed loop circuit to regulate the variable power demanded by a load.

16. The method of claim 12 further comprising the step of controlling the amplitude of the power source output by changing the angle of the dynamically adjustable swash plate of the dynamically variable displacement axial piston pump.

17. The method of claim 12 wherein the bottom hole assembly further comprises a mud flow rate sensor, and the method further comprises the step of providing substantially realtime mud flow rate data to the microcontroller assembly.

18. The method of claim 17 further comprising the steps of:

receiving substantially realtime mud flow rate data from the mud flow rate sensor, controlling the amplitude of the power source output, and changing the angle of the dynamically adjustable swash plate of the dynamically variable displacement axial piston pump in relation to the substantially realtime mud flow rate data received from the mud flow rate sensor.

19. The method of claim 12 wherein the bottom hole assembly further comprises:

a revolution rate sensor configured to be in communication with the microcontroller assembly such that substantially realtime revolution rate data for the bottom hole assembly is provided to the microcontroller assembly, a drill bit capable of axial deflection, and a drill bit deflection amplitude sensor configured to be in communication with the microcontroller assembly such that substantially realtime drill bit deflection amplitude data is provided to the microcontroller assembly.

20. The method according to claim 19 further comprising the steps of:

receiving substantially realtime revolution rate data from the revolution rate sensor, receiving substantially realtime drill bit deflection amplitude data from the drill bit deflection amplitude sensor, controlling the amplitude of the power source output and changing the angle of the dynamically adjustable swash plate of the dynamically variable displacement axial piston pump in relation to one or both of the substantially realtime revolution rate data and the substantially realtime drill bit deflection amplitude data.

21. A wireline conveyed tool comprising:

a power source, comprising:

a dynamically adjustable swash plate, a dynamically variable displacement axial piston pump, and an electric motor that drives an input shaft of the dynamically variable displacement axial piston pump; and a microcontroller assembly comprising:

a processor, a nonvolatile memory element, a program stored in the nonvolatile memory configured to control the amplitude of the power source output by changing the angle of the dynamically adjustable swash plate of the dynamically variable displacement axial piston pump.

22. The wireline conveyed tool of claim 21, wherein the power source further comprises an axial piston pump actuator configured to control the angle of the swash plate.

23. The wireline conveyed tool of claim 21, wherein the power source further comprises a charge pump configured to provide minimum flow to the dynamically variable displacement axial piston pump.

24. The wireline conveyed tool of claim 21, wherein the power source further comprises a low pressure input line configured with a check valve and a pathway to a hydraulic reservoir through the check valve to provide additional fluid to the dynamically variable displacement axial piston pump.

25. The wireline conveyed tool of claim 21, wherein the dynamically variable displacement axial piston pump is configured in a hydraulic open loop circuit to regulate the variable power demanded by a load.

26. The wireline conveyed tool of claim 21, wherein the dynamically variable displacement axial piston pump is configured in a hydraulic closed loop circuit to regulate the variable power demanded by a load.

* * * * *